US012226681B2

(12) United States Patent
Gallagher

(10) Patent No.: US 12,226,681 B2
(45) Date of Patent: Feb. 18, 2025

(54) BILATERAL KICKING BOARDS FOR NON-SWIMMERS TO THE ELITE LEVEL SWIMMER

(71) Applicant: Rip Current Sports, LLC, Kensington, MD (US)

(72) Inventor: Jose-Luis Gallagher, Kensington, MD (US)

(73) Assignee: Rip Current Sports, LLC, Kensington, MD (US)

( * ) Notice: Subject to any disclaimer, the term of this patent is extended or adjusted under 35 U.S.C. 154(b) by 393 days.

(21) Appl. No.: 17/545,454

(22) Filed: Dec. 8, 2021

(65) Prior Publication Data

US 2022/0176220 A1 Jun. 9, 2022

Related U.S. Application Data

(60) Provisional application No. 63/122,668, filed on Dec. 8, 2020.

(51) Int. Cl.
*A63B 69/14* (2006.01)

(52) U.S. Cl.
CPC ..... *A63B 69/14* (2013.01); *A63B 2209/00* (2013.01); *A63B 2225/605* (2013.01)

(58) Field of Classification Search
CPC ..... A63B 69/14; A63B 2209/00; A63B 2225/605; A63B 2225/09
USPC ..... 441/58
See application file for complete search history.

(56) References Cited

U.S. PATENT DOCUMENTS

| | | | | |
|---|---|---|---|---|
| 662,069 | A * | 11/1900 | Hoglund | A63B 31/08 2/20 |
| 5,651,710 | A * | 7/1997 | Rives | A63B 31/10 441/56 |
| 9,308,418 | B2 * | 4/2016 | Davis | A63B 31/10 |
| 2004/0203301 | A1 | 10/2004 | Johnson | |
| 2011/0165804 | A1 | 7/2011 | Wenzel | |
| 2017/0232303 | A1 | 8/2017 | Chadwick et al. | |
| 2018/0200579 | A1 | 7/2018 | Davis et al. | |

FOREIGN PATENT DOCUMENTS

| | | |
|---|---|---|
| CN | 2612424 Y | 4/2004 |

OTHER PUBLICATIONS

Laura Hamel, VoloBlades and VB AIR Review by Swimmer Magazine, Jan.-Feb. 2015, vol. 11, No. 1, United States.

* cited by examiner

*Primary Examiner* — Anthony D Wiest
(74) *Attorney, Agent, or Firm* — Dickinson Wright PLLC

(57) ABSTRACT

The bilateral kicking board includes a body formed of a buoyant material and comprises first and second sides facing each other and extending in a lengthwise direction and third and fourth sides facing each other and extending in a widthwise direction perpendicular to the lengthwise direction. The first and second sides have a same length in the lengthwise direction, and the third and fourth sides have a same width in the widthwise direction. The length of the first and second sides being longer than the width of the third and fourth sides. A plurality of fasteners are provided on a surface of the body. The plurality of fasteners is sequentially arranged along the lengthwise direction, and each of the fasteners is configured to fasten a different respective part of a swimmer's hand to the bilateral kicking board.

3 Claims, 25 Drawing Sheets

BILATERAL KICKING BOARDS FOR NON-SWIMMERS TO THE ELITE LEVEL SWIMMER

CROSS REFERENCE TO RELATED APPLICATIONS

This Patent Application claims the benefit of U.S. Provisional Patent Application Ser. No. 63/122,668 filed Dec. 8, 2020 entitled "BILATERAL KICKING BOARDS FOR NON-SWIMMERS TO THE ELITE LEVEL SWIMMER," the entire disclosure of the application being considered part of the disclosure of this application and hereby incorporated by reference.

BACKGROUND

1. Field

Exemplary embodiments disclosed herein relate to a kicking board and method of using the same, and more particularly, relate to a bilateral kicking board that can be secured to a swimmer's hand with fasteners and can be used to teach swimmers of all skill levels how to improve their kicking and breathing abilities, which is critical to getting the non-swimmer to swim and helping the beginner and intermediate swimmers advance towards their swimming improvement goals.

2. Related Art

Swimming instructors have the important job of teaching swimmers of all ages and abilities how to swim. One of the worst feelings, as a swim instructor, is being unsuccessful in teaching a beginner how to swim. Swim instructors often devote considerable time and effort into developing techniques that are designed to help beginners learn to swim, including reviewing relevant swimming research, taking lessons on how to teach, and learning through real-world trial and error, but despite these efforts, every now and again, swim instructors simply cannot help certain non-swimmers learn to swim.

Swim instructors, when teaching the non-swimmer, rely on teaching aids, such as handheld floating barbells, life jackets, floating foam noodles, the swim instructor's very own limbs, as well as psychological tools and/or toys to calm the non-swimmer's feelings of nervousness. Other devices, in particular kickboards, although made for the more confident beginner kicker, can be particularly helpful to help students practice multiple swimming skills at the same time, including kicking, breathing, timing, and consistency. It is important to note that many non-swimmers, when handed a traditional kickboard and asked to try to kick, may either inch their way forward to the point of exhaustion and eventual quit, may not move forward at all and eventually quit, and/or, may actually go backwards as if they were a vehicle trying to press on the pedal to go forwards only to find that the vehicle only goes in reverse.

The SLYDE handboard is a board that a student can fasten to his or her hands using a strap and resembles a mini-surfboard. The SLYDE handboard includes a single strap that attaches the SLYDE handboard to the hand of the person. However, the SLYDE handboard is not designed to teach students how to swim and does not have a structural configuration or other technical features that would help a non-swimmer learn to swim. In contrast, the SLYDE handboard is a handboard designed to be used for handboarding, which is essentially an advanced bodysurfing technique in which handboarders attach a specially designed handboard to the bodysurfer's preferred hand; the hand without the handboard fastened, paddles the water to help catch the wave and once comfortably riding the wave, the hand that was paddling can be placed on the SLYDE, accompanying the fastened hand so that the handboarders can achieve faster and longer rides along a wave.

The SPEEDO® SMAO paddle is a pulling paddle that attaches to a swimmer's hands using a strap. This paddle is used by the elite swimmer to increase: upper body and arm strength; arm pulling efficiency; and overall upper body power of such swimmer. The SMAO paddle includes tubercles, which are scalloped outer edges that create greater surface area for water to pass over, which allows the elite swimmer to pull more water during sprint drills. However, the SMAO paddle does not have a structural configuration or other technical features that would help a non-swimmer learn to swim, and is only designed for elite level swimmers, not for those that are still learning to swim.

The FINIS® alignment kickboard is a triangular shaped kickboard that attaches to a user's hand using a single strap. Due to the narrowed shape, the alignment kickboard can accommodate for speed. However, the alignment kickboard also does not have a structural configuration or other technical features that would help a non-swimmer learn to swim, but rather, assumes that the user already knows how to swim at a high level.

Thus, there is a need for an instructional kickboard that is specifically designed to help students learn how to swim.

There is also a need for an instructional kickboard that can be customized for students of all sizes, ages, and swimming skill levels.

There is also a need for an instructional kickboard that has superior safety features.

SUMMARY

Exemplary embodiments disclosed herein relate to a kickboard that has a specialized configuration and technical features to help students of all sizes, ages, and swimming skill levels learn to swim.

Exemplary embodiments disclosed herein further relate to a kickboard with superior safety features and an aesthetically pleasing design.

Exemplary embodiments disclosed herein further relate to a method of using and manufacturing the kickboard.

Additional aspects will be set forth in part in the description which follows and, in part, will be apparent from the description, or may be learned by practice of the presented exemplary embodiments.

According to an aspect of an exemplary embodiment, there is provided a bilateral kicking board, comprising: a body formed of a buoyant material, the body comprising: first and second sides facing each other and extending in a lengthwise direction, the first and second sides having a same length in the lengthwise direction, and third and fourth sides facing each other and extending in a widthwise direction perpendicular to the lengthwise direction, the third and fourth sides having a same width in the widthwise direction, the length of the first and second sides being longer than the width of the third and fourth sides; and a plurality of fasteners provided on a surface of the body, wherein the plurality of fasteners is sequentially arranged along the lengthwise direction and each of the fasteners is configured to fasten a different respective part of a swimmer's hand to the bilateral kicking board.

According to another aspect of the present disclosure, the plurality of fasteners include straps that are coupled with the body.

According to yet another aspect of the present disclosure, the plurality of straps includes a finger strap that is configured to engage with at least one finger of the swimmer's hand and a hand strap that is configured to engage with the swimmer's hand and a wrist strap that is configured to engage with the swimmer's wrist. According to still another aspect of the present disclosure, the straps are flexible tubes that extend through respective openings in the body and wherein respective ends of the tubes are connected with washers or rivets that are dimensionally larger than the openings in the body to retain the flexible tubes with the body.

According to a further aspect of the present disclosure, the flexible tubes are attached with fir tree rivets that hold the flexible tubes in engagement with the board.

According to yet a further aspect of the present disclosure, the buoyant material of the body is made of a foam material.

According to still a further aspect of the present disclosure, the foam material includes at least one of an Expanded Polypropylene (EPP) foam, a Cross-linked Polyethylene (XLPE) with added Ethylene-Vinyl Acetate (EVA) foam, a Polystyrene (PS) foam, and an Expanded Polyethylene (EPE) foam.

According to another aspect of the present disclosure, the body has rounded corners interconnecting adjacent sides with one another.

According to yet another aspect of the present disclosure, at least one surface of the body is contoured to better grip the swimmer's hand.

Another aspect of the present disclosure is related to a pair of bilateral kicking boards. The pair of bilateral kicking boards includes a first bilateral kicking board and a second bilateral kicking board configured for engagement with the hands of a swimmer. Each of the first and second bilateral kicking boards having a body formed of a buoyant material. Each of the bilateral kicking boards has first and second sides facing each other and extending in a lengthwise direction. The first and second sides have a same length in the lengthwise direction. Each of the bilateral kicking boards also has third and fourth sides facing each other and extending in a widthwise direction perpendicular to the lengthwise direction. The third and fourth sides having a same width in the widthwise direction. The length of the first and second sides being longer than the width of the third and fourth sides. A plurality of fasteners are provided on a surface of the body. The plurality of fasteners is sequentially arranged along the lengthwise direction, and each of the fasteners is configured to fasten a different respective part of a swimmer's hand to the bilateral kicking board.

According to another aspect of the present disclosure, on each bilateral kicking board, the plurality of fasteners include straps that are coupled with the body.

According to yet another aspect of the present disclosure, on each bilateral kicking board, the plurality of straps includes a finger strap that is configured to engage with at least one finger of the swimmer's hand and a hand strap that is configured to engage with the swimmer's hand and a wrist strap that is configured to engage with the swimmer's wrist.

According to still another aspect of the present disclosure, on each bilateral kicking board, the straps are flexible tubes that extend through respective openings in the body and wherein respective ends of the tubes are connected with washers or rivets that are dimensionally larger than the openings in the body to retain the flexible tubes with the body.

According to a further aspect of the present disclosure, on each bilateral kicking board, the flexible tubes are detachable from the caps and re-attachable to the caps so that the flexible tubes can be re-arranged into different patterns to accommodate different hand sizes.

According to yet a further aspect of the present disclosure, for each bilateral kicking board, the buoyant material of the body is made of a foam material.

According to still a further aspect of the present disclosure, for each bilateral kicking board, the foam material includes at least one of an Expanded Polypropylene (EPP) foam, a Cross-linked Polyethylene (XLPE) with added Ethylene-Vinyl Acetate (EVA) foam, a Polystyrene (PS) foam, and an Expanded Polyethylene (EPE) foam.

According to another aspect of the present disclosure, for each bilateral kicking board, the body has rounded corners interconnecting adjacent sides with one another.

According to yet another aspect of the present disclosure, for each bilateral kicking board, at least one surface of the body is contoured to better grip the swimmer's hand.

Yet another aspect of the present disclosure is related to a method of making a bilateral kicking board. The method includes the step of molding a foam material to make a body that has first and second sides facing each other and extending in a lengthwise direction and has third and fourth sides facing each other. The first and second sides have a same length in the lengthwise direction. The third and fourth sides have a same width in the widthwise direction. The length of the first and second sides is longer than the width of the third and fourth sides. The method proceeds with the step of joining a plurality of fasteners to the body in an arrangement along the lengthwise direction such that the fasteners are configured to fasten different parts of a swimmer's hand to the bilateral kicking board.

According to another aspect of the present disclosure, the fasteners are tubes made of a flexible material.

BRIEF DESCRIPTION OF THE DRAWINGS

These and/or other aspects will become apparent and more readily appreciated from the following description of the exemplary embodiments, taken in conjunction with the accompanying drawings in which.

DESCRIPTION OF THE ENABLING EMBODIMENTS

Hereinafter, a bilateral kicking board (also referred to as a "bilateral kickboard", a "kickboard", or a "board") according to exemplary embodiments will be described with reference to the accompanying drawings.

Aspects of the present disclosure were conceived to solve the problem of how to get non-swimmers to learn to swim. Teaching non-swimmers how to swim is a critical issue in society that affects millions of people, from young children to the elderly. Drownings occur every day. Further, each type of non-swimmer may have their own challenges that prevent them from learning to swim. For example, with an older student, such as elderly adult woman that does not know how to swim, a problem is that she may be very stiff and may not even be able to bend her limbs properly. Such a client is buoyant, so in theory she should be able to learn to swim. However, the problem is that her breathing may be inconsistent and she may lose control of her legs to the point where it would no longer help her swim; that lack of motion plus inconsistent breathing is a recipe for choking on water and eventual drowning.

The bilateral kicking board according to the exemplary embodiments disclosed herein includes a combination of technical features that can assist non-swimmers in learning how to swim. Certain of the key features of the Bilateral Kicking Boards are as follows: the structural configuration of the board; the density and rigidity of the foam or other material used to make the board; the buoyancy, size and shape of the board; and the material used to strap the fingers and base of the hand and/or the beginning of the wrist, onto the board.

Figure 1B:
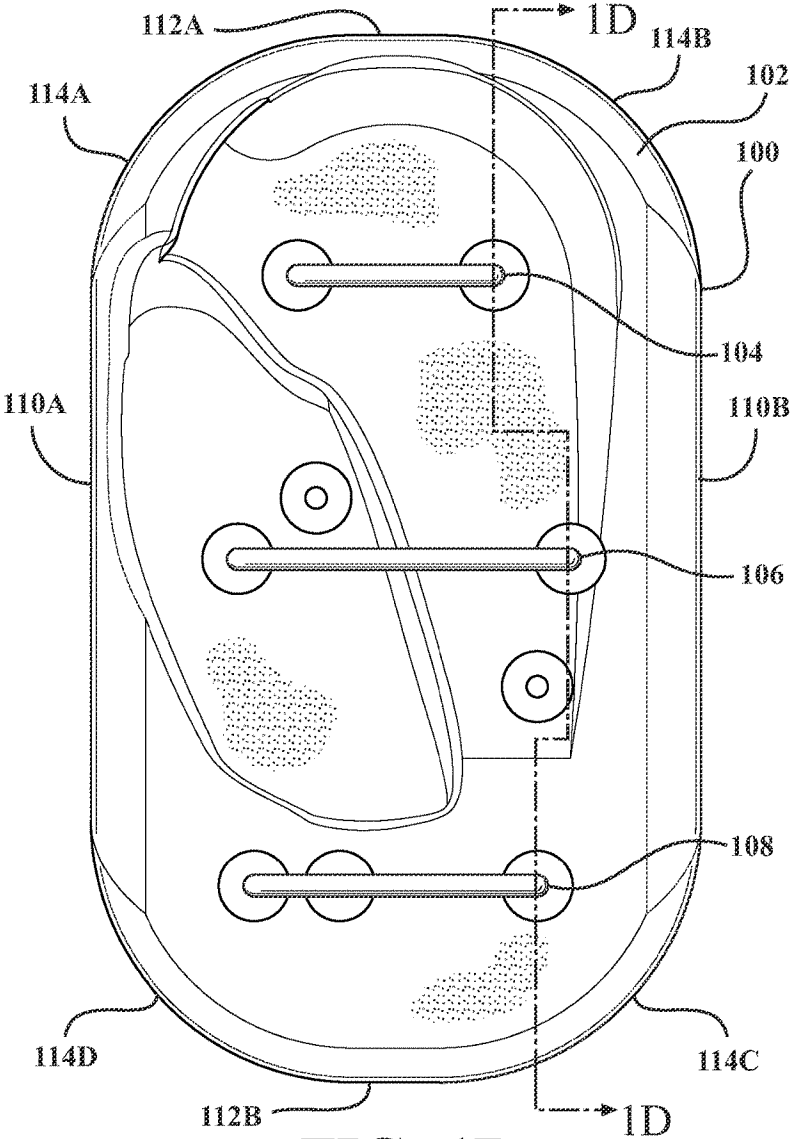
FIGS. 1A, 1B, 1C, 1D, 1E, and 1F illustrate a bilateral kicking board according to an exemplary embodiment.
Figure 1A:
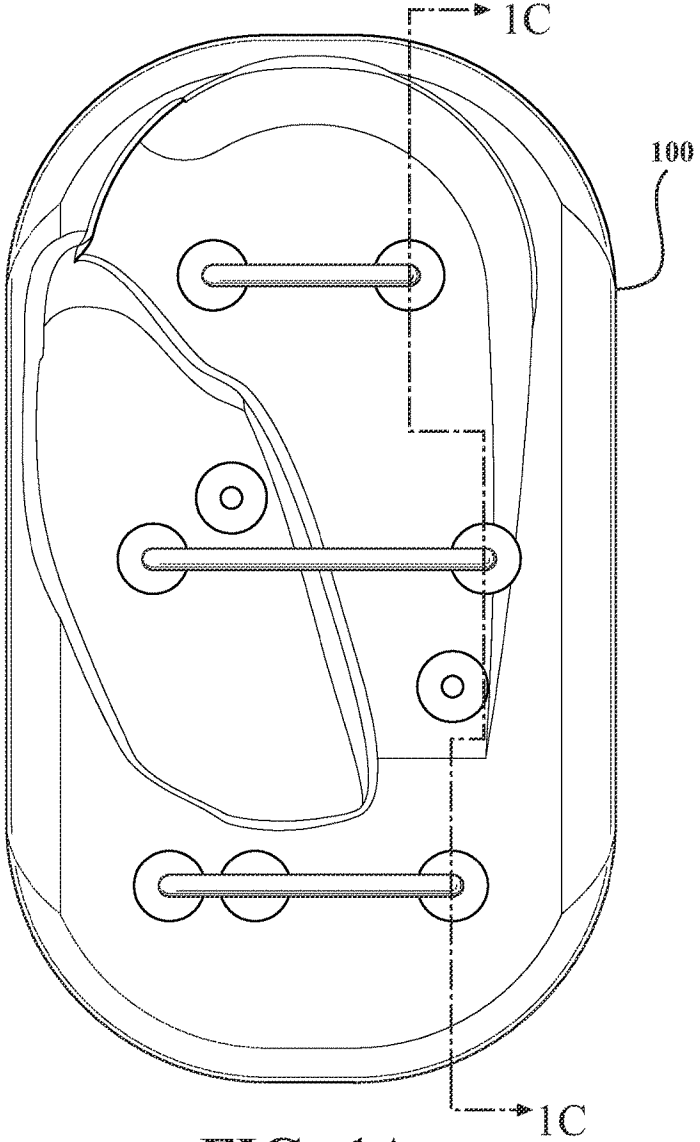
Figure 1C:
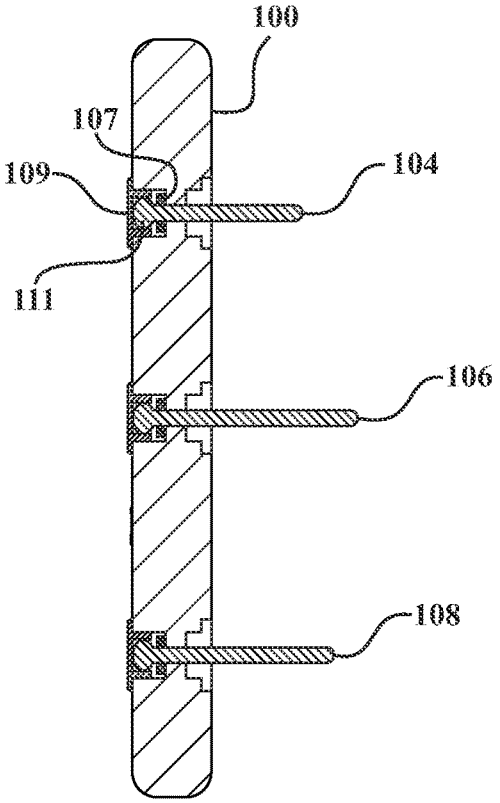
Figure 1D:
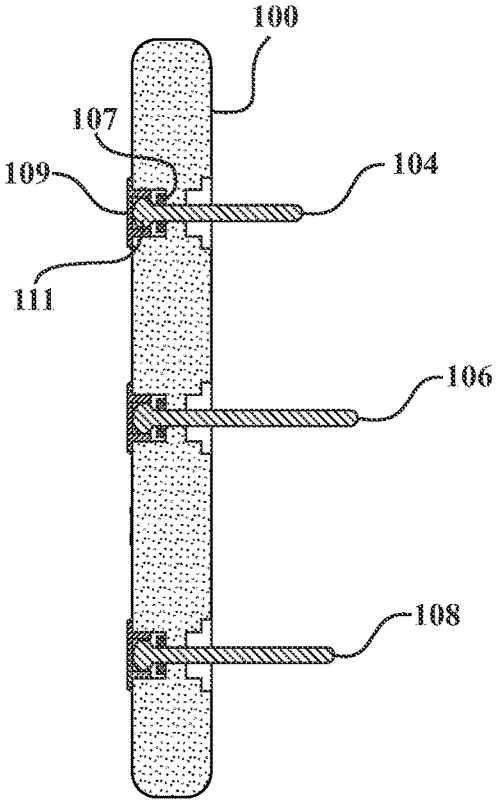
Figure 1E:
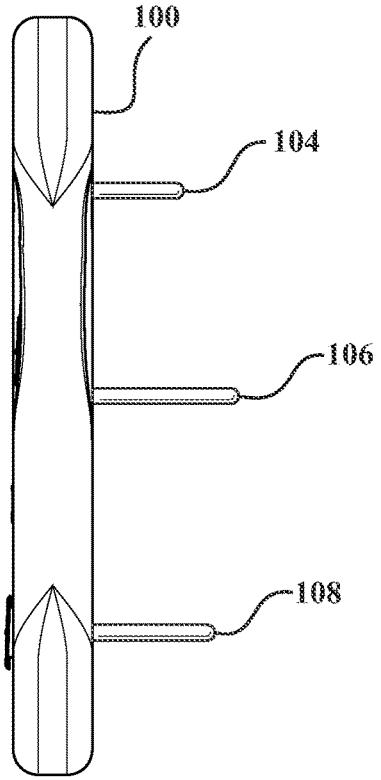

FIGS. 1A, 1B, 1C, 1D, 1E, and IF illustrate a bilateral kicking board (also referred to as a "kicking board", a "kickboard", and a "board") according to a first exemplary embodiment. FIGS. 1A and 1B illustrate a plan view of the bilateral kicking board 100. FIGS. 1C and 1D illustrate a sectional view of the bilateral kicking board 100. FIGS. 1E and IF illustrate an elevation view of the bilateral kicking board 100.

In FIG. 1A, the bilateral kicking board 100 according to the first exemplary embodiment has a length of approximately 12" (vertical direction in FIG. 1A) and a width of approximately 7" (horizontal direction in FIG. 1A). The bilateral kicking board 100 also has a height of approximately 1" (see FIG. 1E). It is understood, however, that the dimensions of FIG. 1A are exemplary only and the bilateral kicking board 100 is not limited to these dimensions.

As shown in FIG. 1B, the bilateral kicking board 100 includes a body 102 defined by two long flat sides 110A and 110B, two short flat sides 112A and 112B, and rounded corners 114A, 114B, 114C, and 114D, a finger strap 104, a hand strap 106, and a wrist strap 108. Two of the bilateral kicking boards 100 will typically be used by each student (also referred to as a "kicker") during swim lessons, so that the student can attach one of the bilateral kicking boards 100 to one of his or her hands, and the other of the bilateral kicking boards 100 to the other of his or her hands. FIGS. 1A and 1B use different shading techniques (solid white in FIG. 1A and hatch marks in FIG. 1B) to illustrate two different bilateral kicking boards 100, each having the same configuration.

According to an exemplary embodiment, the body 102 is made out of foam. For example, the body 102 may be Expanded Polypropylene (EPP) foam. Alternatively, the body 102 may be a Cross-linked Polyethylene (XLPE) with added Ethylene-Vinyl Acetate (EVA) (which may sometimes be referred to as "EVA foam"), a Polystyrene (PS), an Expanded or "Beaded" Polyethylene (EPE), or some other type of foam. Foams of a lesser density, such as a two (2) pound foam, could be used for intermediate, advanced and elite swimmers.

A swimmer of these levels will benefit from using a lesser density foam as the lesser density foam allows for elite level kicking body positions to be attained. For example, an elite freestyle kicker could have his or her front arm extended with his or her hand on top of one of the bilateral kicking boards 100 and yet the board 100 would be submerged in the swimmer's ideal position, perhaps 3 to even 6 inches under the surface of the water; this while the swimmer's opposite arm, with his or her hand also on top of another bilateral kicking board 100, rests down at the swimmers side where the swimmer applies downward pressure to the other bilateral kicking board 100, thus allowing for the swimmer's body to rise to a higher position in the water. Technically, the shape of the board 100 is the same in the front and back, i.e., a shape which approximates the shape of a hockey rink. That is, the board has rounded corners that connect adjacent linear sides with one another. The reason for this design is to account for both buoyancy contribution: the more surface area the board has, the more it is able to help the non-swimmer feel at ease floating atop the water, and, hydrodynamics; if the back of board down at the side of the swimmer, were the shape of the "traditional" kickboard, flat, the arm at the side would meet resistance as the flat part of the board leads such arm through the water. All elite swimmers spend years of training their bodies to swim on top of the water, from their fingertips to their toes. Foams can increase in density, such as a 4-pound density foam, for the beginner to non-swimmer, especially if that swimmer is, for example, greater than 145 pounds and has trouble getting a breath when he or she swims freestyle. For these beginner swimmers or non-swimmers, the front board 100, which is the board 100 that is attached to the arm that is extended, will need to rest on the water such that the board 100 does not go too deep, meaning more than 1 inch or thereabouts, under the surface of the water. Beginner swimmers and non-swimmers find comfort when they are assisted by an object that does not submerge too much—they are more willing to try to kick for longer periods of time. Also, the greater the density of the board 100, the more a beginner can fail at breathing while at the same time be comfortably on top of the water as they comfortably fail, allowing the beginner to continue to kick rather than quit, due to the fact that the buoyancy of the board 100 gives him or her the confidence and the ability to recover from breathing mistakes as their hands press down on the board which helps keep their head above water such that eventually the swimmer gets the breath they need to put their head back in the water and kick some more. Thus, the bilateral kicking board 100 for entry-level swim students, i.e., beginners and non-swimmers, may be fabricated from extremely buoyant material to help the entry-level swim student learn to swim while also maintaining the student's confidence and providing a safe and effective swimming aid.

According to certain exemplary embodiments, to achieve extreme buoyancy, some versions of the bilateral kicking board 100 might be covered with fiberglass cloth or other types of materials. For example, the bilateral kicking board 100 may be configured as fiberglass cloth, and epoxy or polyester resins, that envelop PS foam, and thus, may achieve extreme buoyancy.

It is further understood that in some embodiments, the board 100 is made of other materials than foam. For example, in some embodiments, the board 100 may be made out of many other types of materials, for example, inflatable materials, plastics, wood, and many other types of materials that may be used instead of, or in combination with, foam materials.

The two long flat sides 110A and 110B are parallel to each other and extend in a lengthwise direction of the board 100 (in the vertical direction in FIGS. 1A and 1B). The two short flat sides 112A and 112B are parallel to each other and extend in a widthwise direction of the board 100 (in the horizontal direction in FIGS. 1A and 1B). The rounded corner 114A connects the long flat side 110A to the short flat side 112A. The rounded corner 114B connects the long flat side 110B to the short flat side 112A. The rounded corner 114C connects the long flat side 110B to the short flat side 112B. The rounded corner 114D connects the long flat side 110A to the short flat side 112B. In the example shown in FIGS. 1A and 1B, the rounded corners 114A, 114B, 114C, and 114D each have the same curvature. It is understood that the rounded corners 114A, 114B, 114C, and 114D may also have different curvatures from each other. These parallel sets of sides interconnected with rounded corners defines the aforementioned hockey rink shape.

The finger strap 104 is a strap that is attached to the board 100 and is configured to strap the student's fingers to the board 100. To achieve this, the finger strap 104 is provided in a location towards the top of the body 102 such that, after a student extends his or her hand through the wrist strap 108 and the hand strap 106, the student's fingers will reach under the finger strap 104, where the student's palm, and all five fingers, fasten flat on the surface of the board. Important to note, the student may wish to extend his or her hand through the wrist strap 108 and hand strap 106, and then wrap his or her fingers around the outside of the strap 104 at the knuckles and curl his or her fingertips down towards the surface of the board 100. However, this fastening mechanism is made to fasten the entire hand flat on the board. In the exemplary embodiment, the board 100 includes at least one imprint that improves contact between the swimmer's hand and the board. The wrist, hand, and fingers therefore, go under silicon straps or flexible tubes; 108, 106, and 104. To further expound, the non-swimmer instinctually grabs water, as if grabbing a bull by the horns, confusing the water as a solid rather than a liquid; they believe grabbing will help them survive. Fastening the hand flat on the board limits the non-swimmer's ability, and subsequently, limits their desire to grab liquid therefore allowing the hand to gain comfort, flat and fastened, in an effective swimming hand position, assisted by the fasteners and bilateral board, so the mind understands, prior to attempting to kick, that the hand will remain fastened and flat and that the swimmer will have to focus on the real task at hand, kicking the body forward, attempting to breathe, and repeating the process through failed breaths and successful ones until the process is practiced often enough so that the swimmer attains the ability to swim with 100% swim breathing efficiency. In the example shown in FIG. 1B, the finger strap 104 is made from a silicon tube material.

The hand strap 106 is a strap that is attached to the board 100 and is configured to strap the student's hand to the board 100. To achieve this, the hand strap 106 is provided in a location towards the middle of the body 102 such that, after a student extends his or her hand through the wrist strap 108, the student's hand (e.g., palm) will be held against a surface of the board 100 by the hand strap 106. In the example shown in FIG. 1B, the hand strap 106 is made from a silicon tube material.

The wrist strap 108 is a strap that is attached to the board 100 and is configured to strap the student's wrist to the board 100. To achieve this, the wrist strap 108 is provided in a location towards the bottom of the body 102 such that, when a student extends his or her hand through the wrist strap 108, the student's wrist will be held against a surface of the board 100 by the wrist strap 108. In the example shown in FIG. 1B, the wrist strap 108 is made from a silicon tube material.

The finger strap 104, hand strap 106, and wrist strap 108 are described above as being implemented as silicon tube straps, but exemplary embodiments are not limited thereto, and the straps 104, 106, 108 may be made out of many different types of materials, such as surgical tubing, Velcro strapping, or adjustable bands. Each of these different devices used to fasten the board 100 to the swimmer's hand (e.g., silicon tubing, straps, bands, etc.) may generally be referred to as a "fastener", "fastening device", etc.

In the first exemplary embodiment, respective ends of the flexible tube straps 104, 106, 108 extend through openings in the board 100 and engage with respective washers 107, which are received in counterbores of the openings and have greater outer diameters than the openings. Specifically, the flexible tube straps 104, 106, 108 extend through openings in the washers 107 and are knotted. The knots 111 prevent the ends of the tube straps 104, 106, 108 from being pulled through the openings of the washers 107, and washers are sized so that they cannot be pulled through the openings in the board 100. Caps 109 are also placed in the openings on the bottom side of the board 100 (i.e., an opposite side of the board 100 from the swimmer's hand) to hide the knots and washers 107. The caps 109 are made of plastic, and each cap has a first portion that extends into the counterbore of the opening of the board 100 and a flange portion with a greater or similar radius to the opening. The outer surfaces of the caps 109 lie flush with a bottom surface of the board 100.

Figure 19:
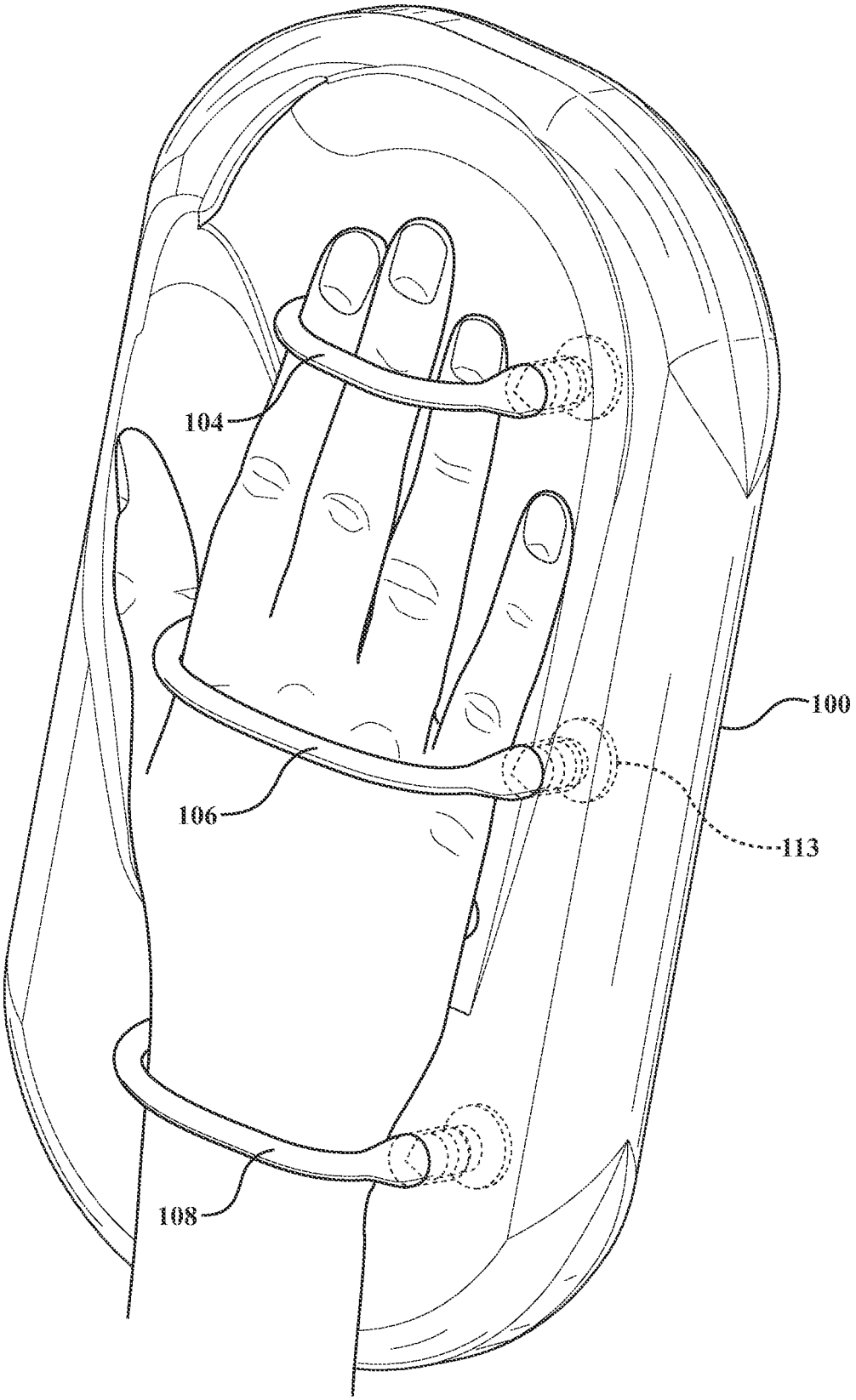
FIG. 19 illustrates an alternate embodiment of the bilateral kicking board and with a hand in place.

Referring now to FIG. 19, in another embodiment, a fir tree rivet 113 is received within each end of each of the flexible tube straps 104, 106, 108. The fir tree rivet 113 has an enlarged head and a two opposing portions, each with a plurality of axially spaced apart ribs or barbs and has a through bore that extends from an open end of one of the portions to an open end of the other portion. The ribs of one of the portions engage directly with an inner diameter of an associated one of the flexible tube straps 104, 106, 108, and the ribs of the other portion engage directly with the material of the board 100 within an associated one of the openings. In this embodiment, the openings do not include counterbores, thereby reducing the overall density of the board 100 by increasing the amount of foam material and improving the board's 100 hydrodynamic efficiency by eliminating spaces that water could collect in.

FIGS. 1C and 1D illustrate a sectional (cross-sectional) view of the bilateral kicking board 100. The section view illustrates the board 100 from the inside of the board 100 (as if the board 100 were split down the middle). As shown therein, the wrist strap 108, hand strap 106, and finger strap 104 are sequentially arranged from top to bottom along the lengthwise direction of the body 102 (the direction in which the long flat sides 110A and 110B extend), thereby achieving excellent gripping results for a student. In the first exemplary embodiment, the hand strap 106 is longer than the finger and wrist straps 104, 108. In some embodiments, any configuration of two straps 104, 106, 108 may be provided. For example, in one embodiment, the board 100 includes only the finger and hand straps 104, 106; in another embodiment, the board 100 includes only the hand and wrist straps 106, 108; and in yet another embodiment, the board 100 includes only the finger and wrist straps 104, 106.

Figure 17A:
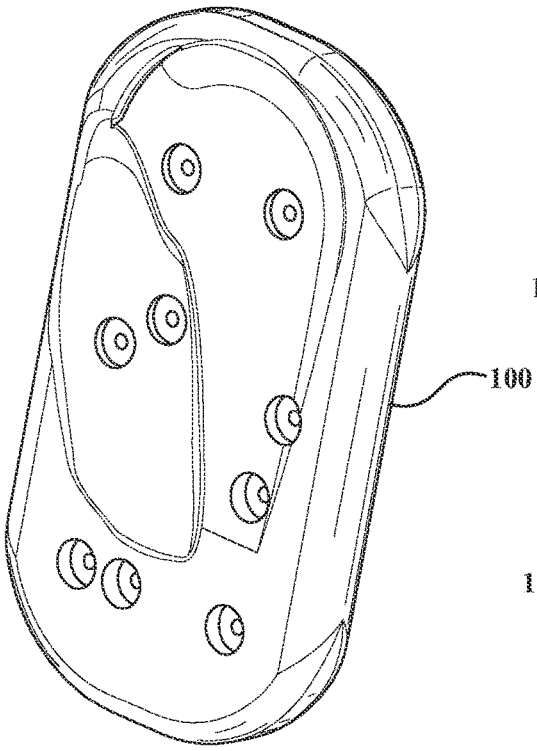
FIGS. 17A, 17B, 17C, and 17D illustrate perspective views of the bilateral kicking board shown in FIGS. 1A-1F with different strap configurations.
Figure 17B:
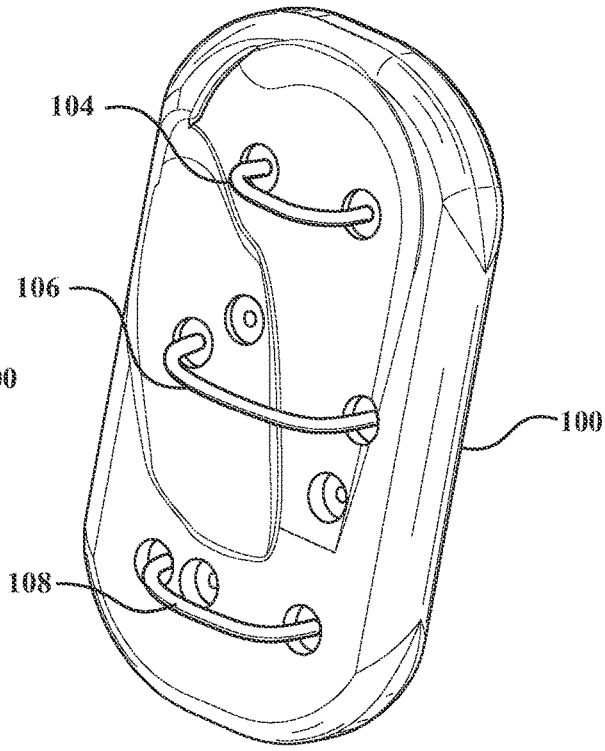
Figure 17C:
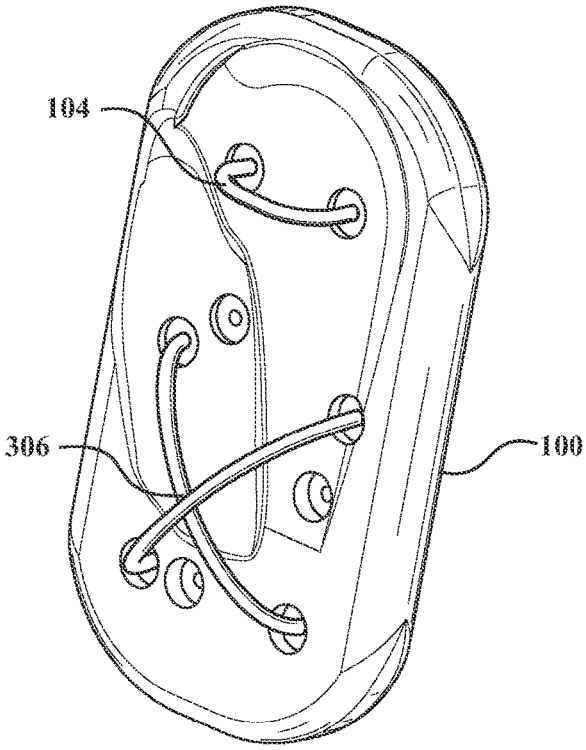
Figure 17D:
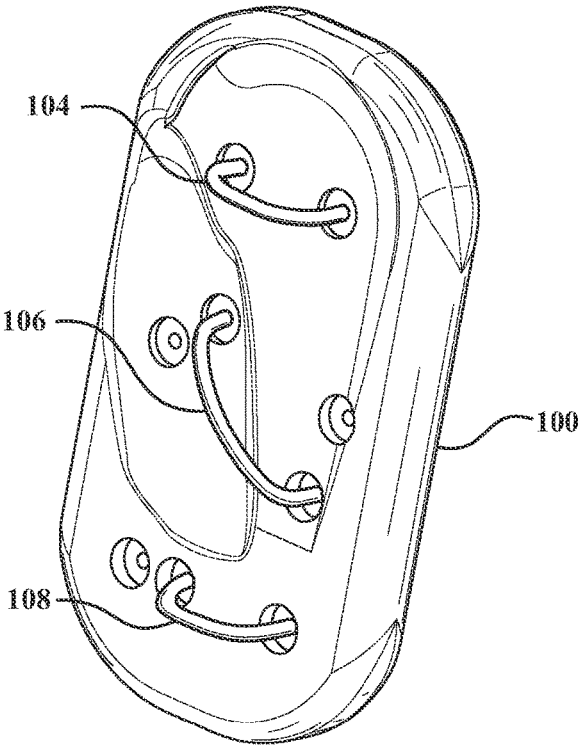

Referring now to FIG. 17D, another configuration of the straps 104, 106, 108 is depicted that is configured to better engage with the hand of a youth swimmer. In this embodiment, the hand strap 106 extends at an angle as opposed to parallel to the finger and wrist straps 104, 108 as is the case in the adult configuration described above and shown in FIG. 1. The board is provided with nine openings to accommodate these different configurations. The finger strap 104 is consistent for both the adult and junior configurations, while the hand and wrist straps 106, 108 are placed in either the narrower junior configuration or the wider adult configuration. For the wrist strap 108, in the junior configuration, the two rightmost holes are used to fasten the strap 108. For the hand strap 106, in the junior configuration, the interior aligned holes are used to secure the strap 106 where the left hand the inner top hole, lying higher up on the board 100 lies closest to the left thumb and the inner lower hole rests closest to the left pinkie and vice-versa for the right-handed junior configuration. For the adult configuration, the exterior holes are used to secure the hand strap 106 for both the left and right handed boards 100.

Figure 1F:
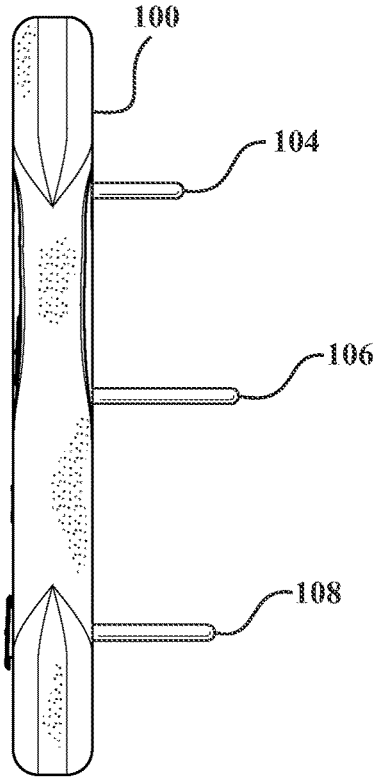

Referring now to FIGS. 1E and 1F illustrate an elevation view of the bilateral kicking board 100. The elevation view in FIGS. 1E and 1F is similar to the section view in FIGS. 1C and 1D, except that the elevation view shows a perspective of the board 100 from the outside of the board 100. As shown in the elevation view, the board 100 has a height (i.e., a height if the board 100 were to be laid flat) of approximately 1". It is understood, however, that the board 100 may have a height of more or less than 1". While FIGS. 1E and 1F make it appear that the board 100 has a uniform height, the contoured profile on the surface that is gripped by the swimmer's hand may make the height non-uniform.

In the exemplary embodiment, the contoured profile on each side of the board 100 is equal in shape. This allows the board to be symmetrical such that the same board 100 can be manufactured for use with both a swimmer's left and right hands, thereby reducing costs through economies of scale. In some embodiments, one of the surfaces can be non-contoured or can be U or V-shaped.

Referring now to FIGS. 2A, 2B, 2C, 2D, 2E, and 2F, a second exemplary embodiment of the bilateral kicking board is generally shown with like numerals, separated by a prefix of "2," identifying like components with the first exemplary embodiment described above.

Figure 2B:
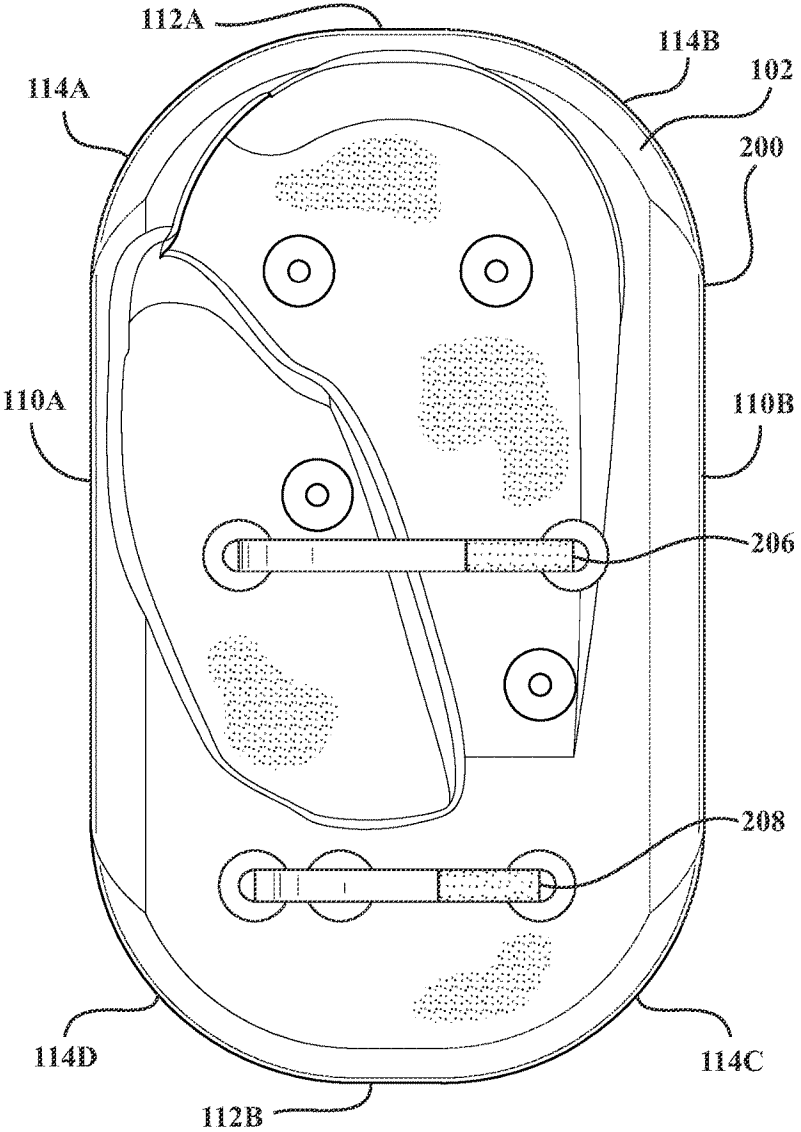
FIGS. 2A, 2B, 2C, 2D, 2E, and 2F illustrate a bilateral kicking board according to another exemplary embodiment.
Figure 2A:
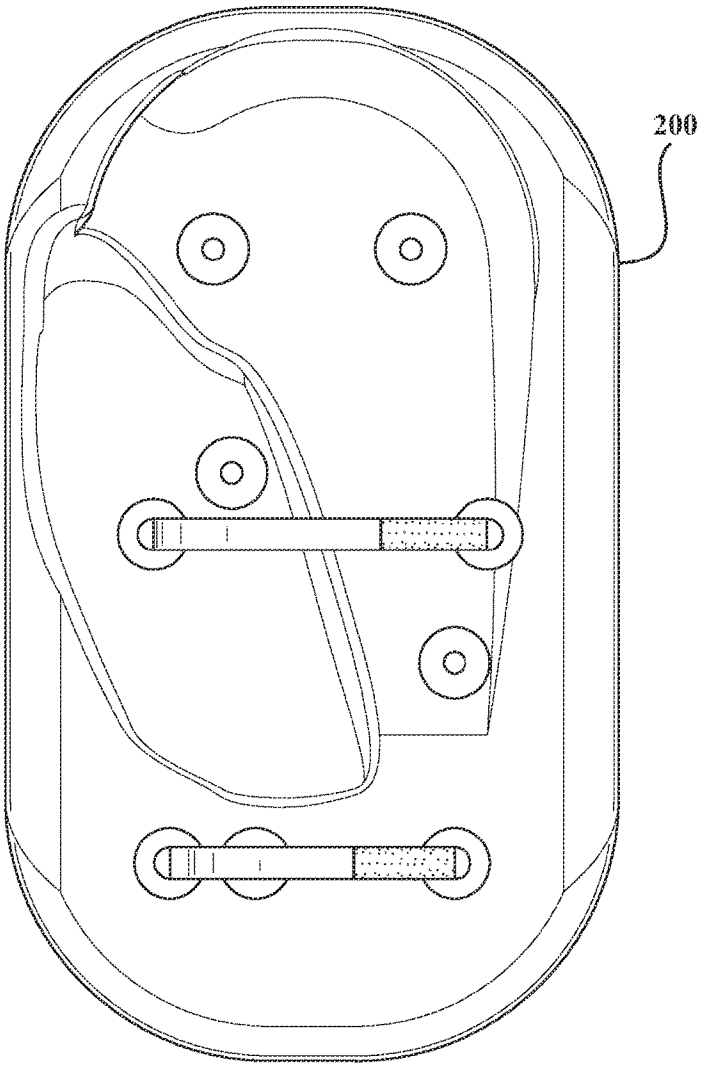

As shown in FIG. 2B, the body 102 of the board 200 has approximately the same size and shape as the body 102 of the board 100 shown in FIG. 1B. One of the differences between the board 200 and the board 100 is that the board 200 has a hand strap 206 and a wrist strap 208, but does not have a finger strap like the board 100. Furthermore, the hand strap 206 and wrist strap 208 of the board 200 are each thicker than the hand strap 106 and wrist strap 108 of the board 100.

According to an exemplary embodiment, the hand strap 206 and the wrist strap 208 are Velcro® straps that are attached to the board 200 and configured to strap the student's wrist to the board 200. It is understood, however, that the hand straps 206 and 208 are not limited to being made out of Velcro®, and may be made out of many different types of materials, such as silicon tubing, surgical tubing, or adjustable bands.

Figure 2C:
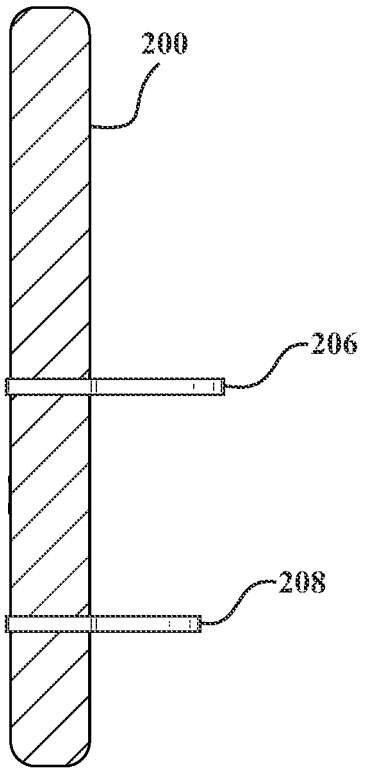
Figure 2D:
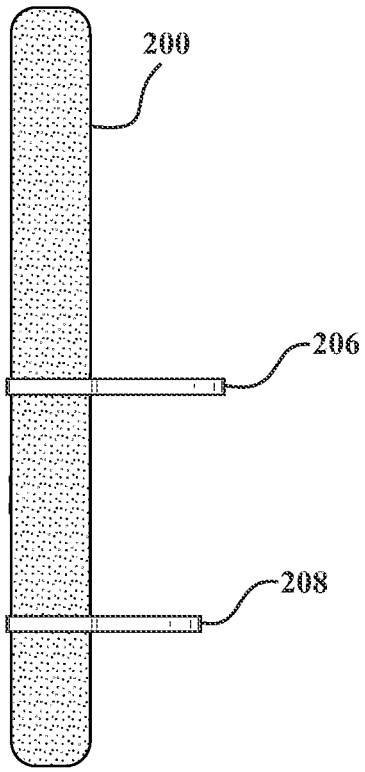

FIGS. 2C and 2D illustrate a sectional (cross-sectional) view of the bilateral kicking board 200. As shown therein, the wrist strap 208 and hand strap 206 are sequentially arranged from a middle of the board 200 to the bottom 200 of the board along the lengthwise direction of the body 102 (the direction in which the long flat sides 110A and 110B extend), thereby achieving excellent gripping results for a student.

Figure 2E:
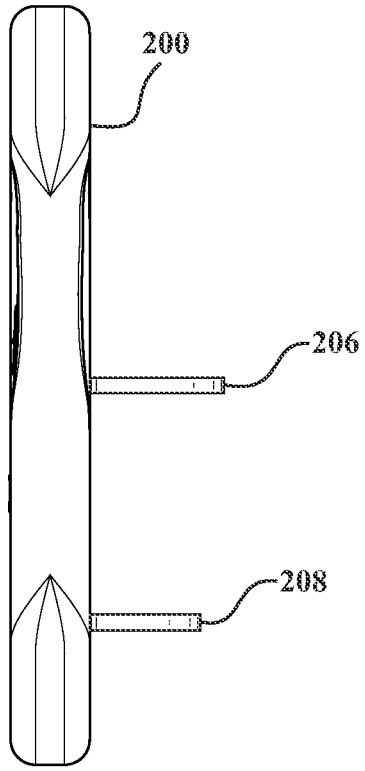
Figure 2F:
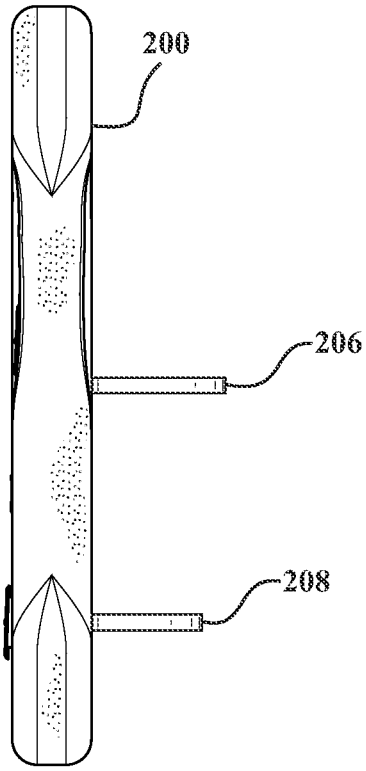

FIGS. 2E and 2F illustrate an elevation view of the bilateral kicking board 200. The board 200 has a height (i.e., a height if the board 200 were to be laid flat) of approximately 1". It is understood, however, that the board 200 may have a height of more or less than 1", and may be uniform or non-uniform as described above with respect to FIGS. 1E and 1F.

FIGS. 3A, 3B, 3C, 3D, 3E, and 3F illustrate a third exemplary embodiment of the bilateral kicking board with like numerals, separated by a prefix of "3," identifying like components with the embodiments described above.

Figure 3B:
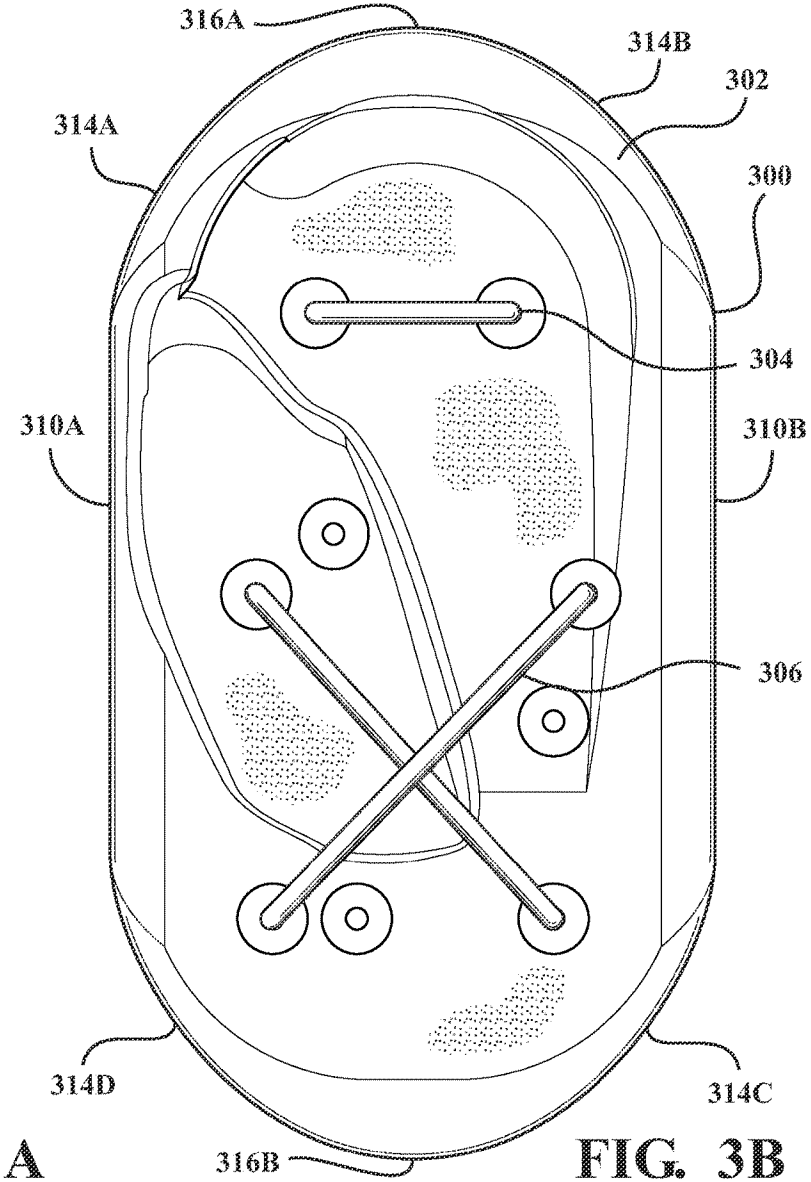
FIGS. 3A, 3B, 3C, 3D, 3E, and 3F illustrate a bilateral kicking board according to yet another exemplary embodiment.
Figure 3A:
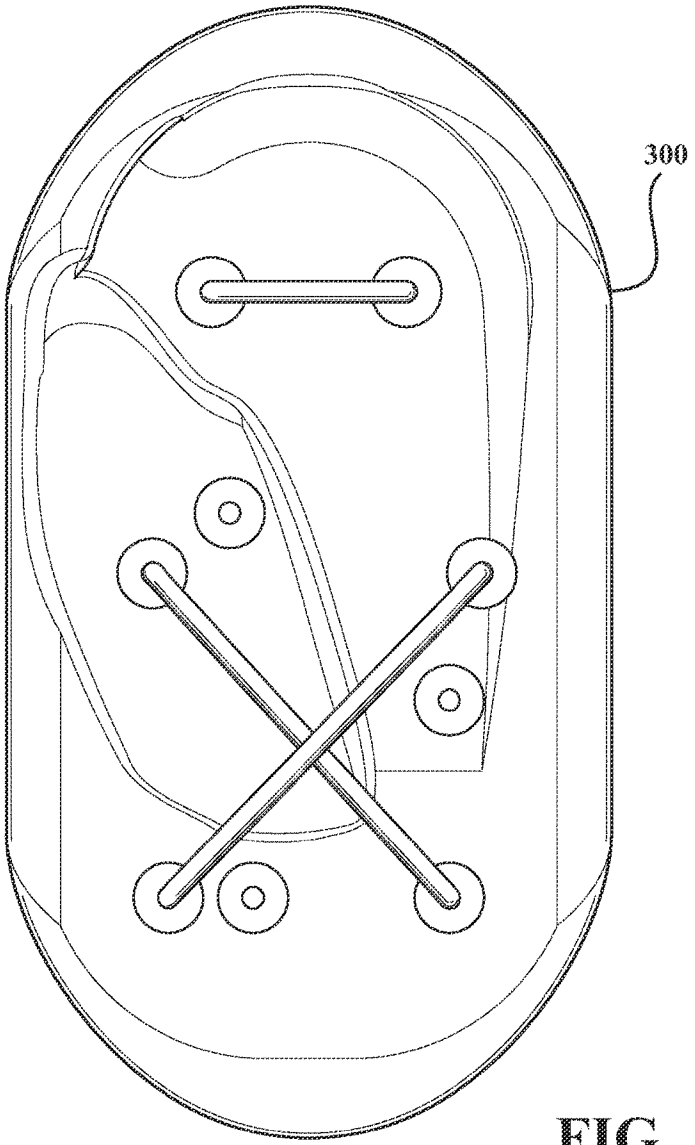

In FIG. 3A, the bilateral kicking board 300 according to an exemplary embodiment has a length of approximately 12" (vertical direction in FIG. 3A) and a width of approximately 7" (horizontal direction in FIG. 3A). The bilateral kicking board 300 also has a height of approximately 1" (see FIG. 3E). It is understood, however, that the dimensions of FIG. 3A are exemplary only and the bilateral kicking board 300 is not limited to these dimensions.

As shown in FIG. 3B, the board 300 includes a body 302 defined by two long flat sides 310A and 310B, a first curved side 314A, a second curved side 314B, a third curved side 314C, and a fourth curved side 314D, a finger strap 304, and a combined wrist and hand strap 306. The first curved side 314A connects a first end of the long flat side 310A to an upper vertex 316A, the second curved side 314B connects a first end of the long flat side 310B to the upper vertex 316A, the third curved side 314C connects a second end of the long flat side 310B to a lower vertex 316B, and the fourth curved side 314D connects a second end of the long flat side 310A to the lower vertex 316B. As such, the shape of the board 300 somewhat resembles an oval shape with flat sides and pointed tips at the front and back.

One of the technical benefits of the shape of the board 300 is as follows. To accommodate for speed, the shape of the front of the board 300 is narrowed and potentially the foam at the tip can be made less thick so as to take on a more hydrodynamic sharpness. Similar to the board 100 with the hockey rink shape, should the front of the board 300 narrow, the back of the board 300 can be made to narrow much the same so as to allow a kicker more equal hydrodynamics when one arm is extended in front and the other arm down at the kicker's side. The arm at the swimmer's side should share equal hydrodynamics as it is kicked through the water as the arm extended in front; this feature allows for the kicker to develop the kick with hydrodynamic ease, whether they be a non-swimmer or an elite swimmer. To reiterate the concept mentioned above with respect to the board 100, if the shape were a "traditional" kickboard shape, and a swimmer used this "traditional" kickboard shape in the aforementioned position (arm extended out front, other arm down at the side, both boards on top of the water), the arm at the side would meet resistance as the backside or "stern-side" of the board would be leading that arm through the water as opposed to a nice sharp hydrodynamic "bow" leading that arm through the water.

The finger strap 304 may be substantially the same dimensions as the finger strap 104 and may be made of substantially the same materials as the finger strap 104. In the example shown in FIG. 3B, the finger strap 304 is made of silicon tubing.

The combined wrist and hand strap 306 includes two straps that cross each other to form an X-shaped strap that fastens the hand and wrist of the student to the board 300. The combined wrist and hand strap 306 may be made of the same materials as the finger strap 304, e.g., silicon tubing, Velcro®, surgical tubing, adjustable bands, etc. In the example shown in FIG. 3B, the hand strap 304 is made of silicon tubing. One of the technical benefits of the combined wrist and hand strap 306 is that, due to the X-shaped configuration, the combined wrist and hand strap 306 has an increased surface area for gripping the student's hand, thereby providing additional fastening support.

Figure 3C:
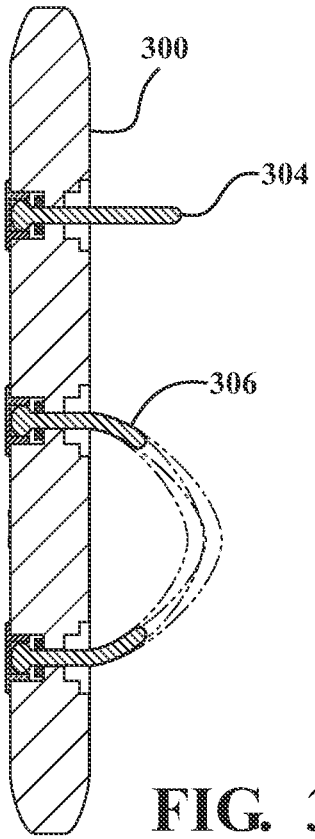
Figure 3D:
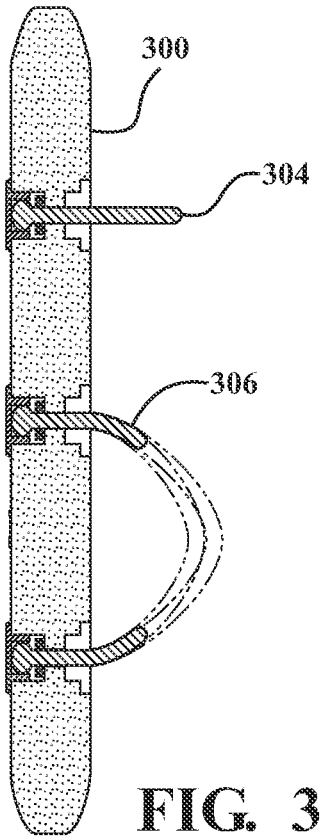

FIGS. 3C and 3D illustrate a sectional (cross-sectional) view of the bilateral kicking board 300. As shown therein, the finger strap 304 and combined wrist and hand strap 306 are sequentially arranged from the top to the bottom 300 of the board along the lengthwise direction of the body 302 (the direction in which the long flat sides 310A and 310B extend), thereby achieving excellent gripping results for a student.

Figure 3E:
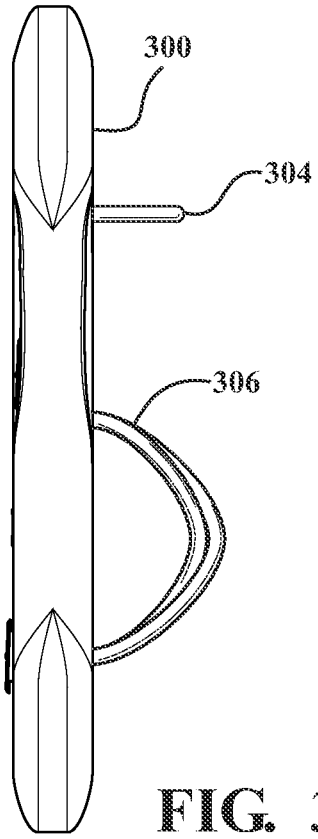
Figure 3F:
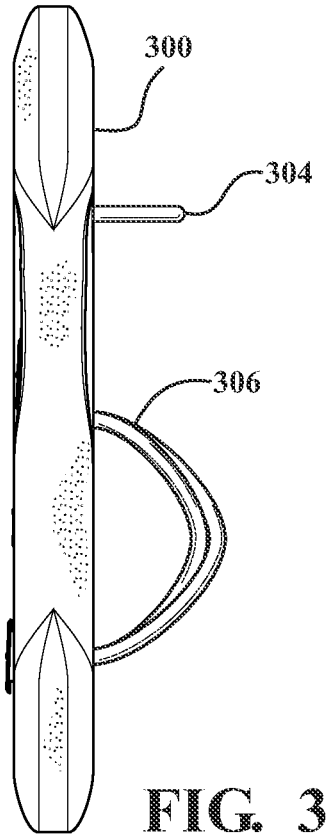

FIGS. 3E and 3F illustrate an elevation view of the bilateral kicking board 300. The board 300 has a height (i.e., a height if the board 300 were to be laid flat) of approximately 1". It is understood, however, that the board 300 may have a height of more or less than 1" and may be uniform or non-uniform as described above with respect to FIGS. 1E and 1F.

FIGS. 4A, 4B, 4C, 4D, 4E, and 4F illustrate a bilateral kicking board according to a fourth exemplary embodiment with like numerals, separated by a prefix of "4," identifying like components with the above-discussed embodiments.

Figure 4B:
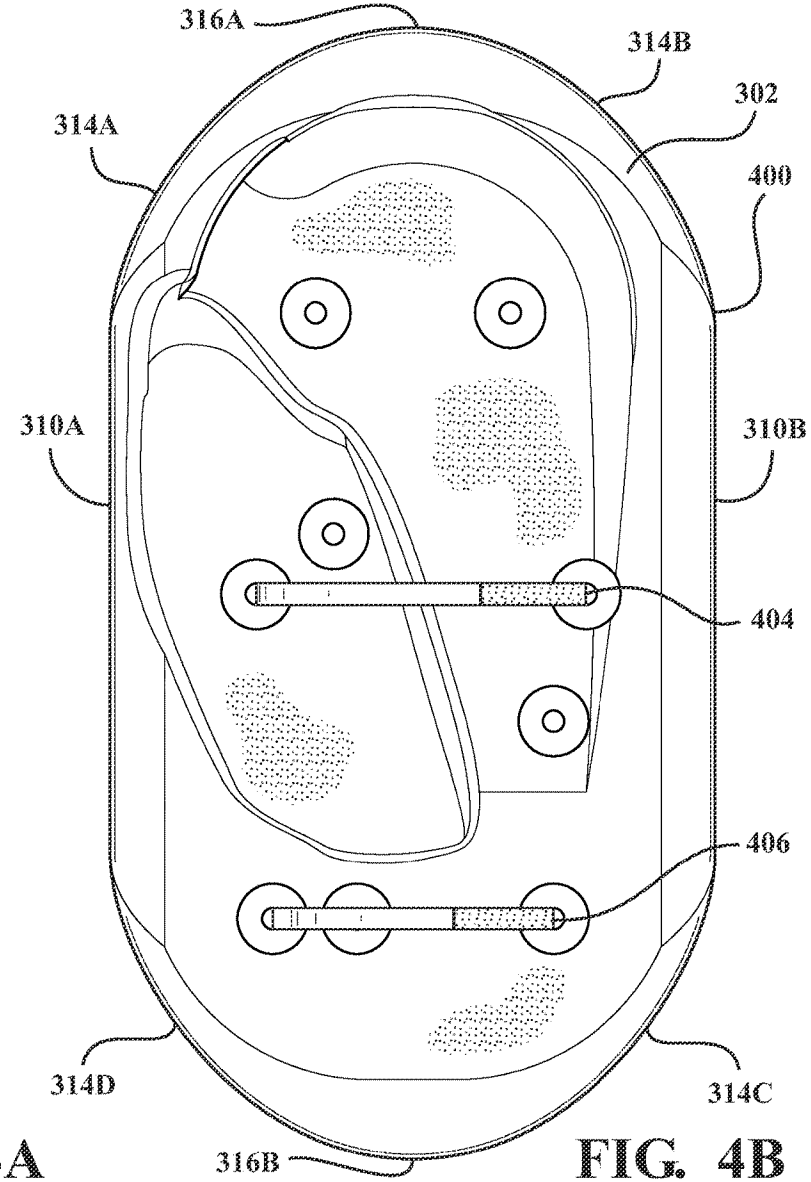
FIGS. 4A, 4B, 4C, 4D, 4E, and 4F illustrate a bilateral kicking board according to still another exemplary embodiment.
Figure 4A:
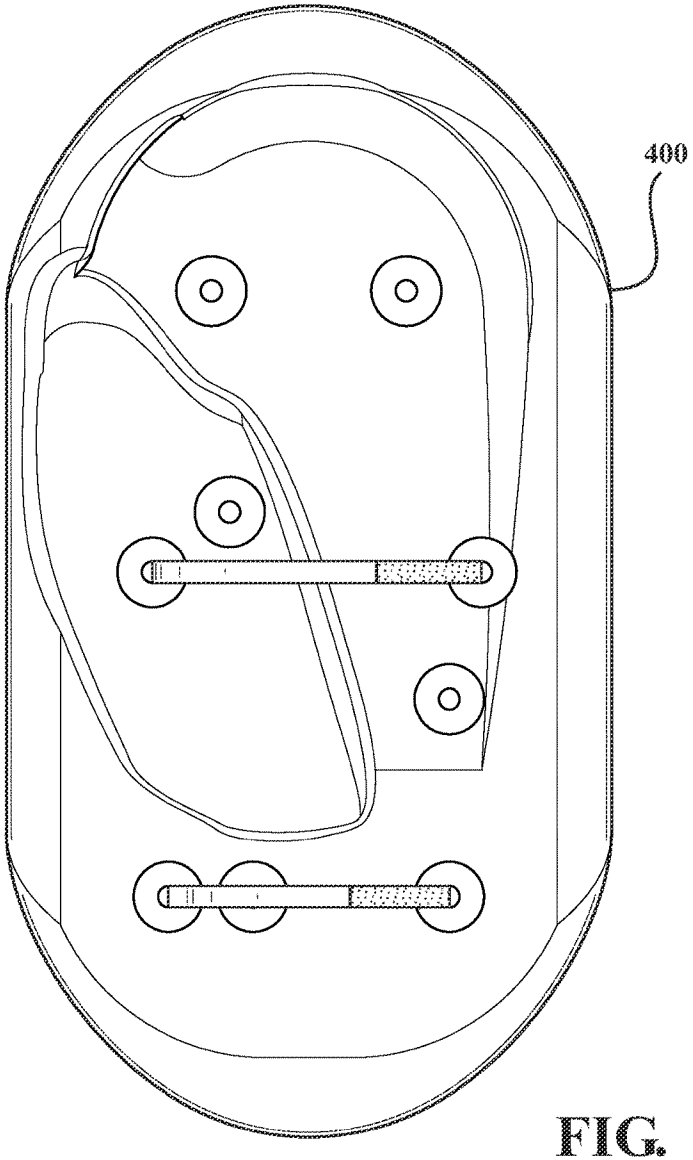

In FIG. 4A, the bilateral kicking board 400 according to this exemplary embodiment has a length of approximately 12" (vertical direction in FIG. 4A) and a width of approximately 7" (horizontal direction in FIG. 4A). The bilateral kicking board 400 also has a height of approximately 1" (see FIG. 4E). It is understood, however, that the dimensions of FIG. 4A are exemplary only and the bilateral kicking board 400 is not limited to these dimensions.

As shown in FIG. 4B, the body 302 of the board 400 is the same as the body 302 of the board 300.

One of the differences between the board 400 and the board 300 is that the board 400 has a hand strap 404 and a wrist strap 406, but does not have a combined wrist and hand strap 306 like the board 300. Furthermore, the hand strap 404 and wrist strap 406 of the board 400 are each thicker than the hand strap 304 and combined wrist and hand strap 306 of the board 300.

According to an exemplary embodiment, the hand strap 404 and the wrist strap 406 may be made of the same material as the hand strap 206 and wrist strap 208 (see FIG. 2B).

Figure 4C:
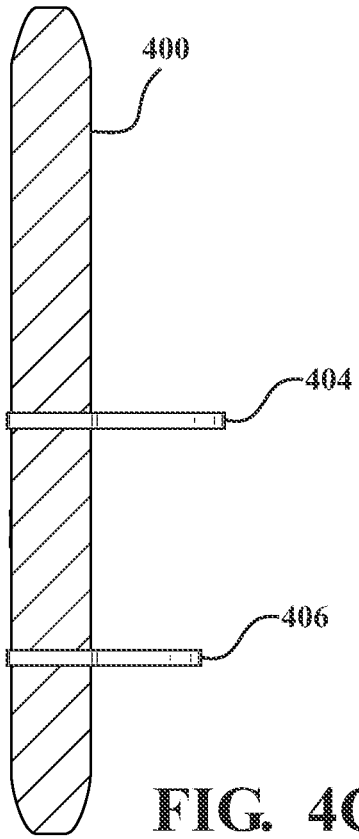
Figure 4D:
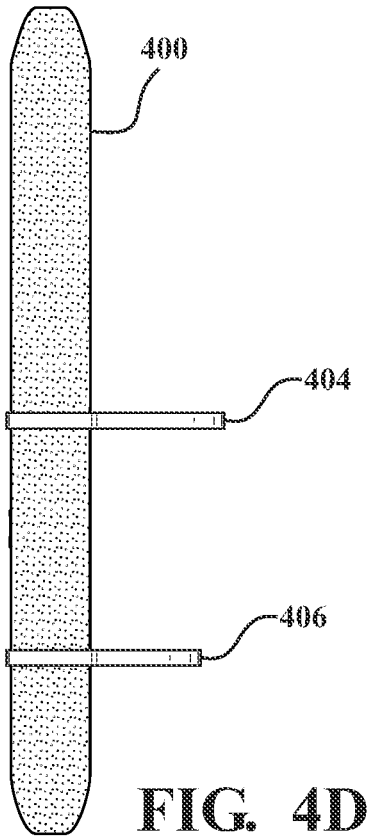

FIGS. 4C and 4D illustrate a sectional (cross-sectional) view of the bilateral kicking board 400. As shown therein, the hand strap 404 and wrist strap 406 are sequentially arranged from a middle of the board 400 to the bottom of the board 400 along the lengthwise direction of the body 302 (the direction in which the long flat sides 310A and 310B extend), thereby achieving excellent gripping results for a student.

Figure 4E:
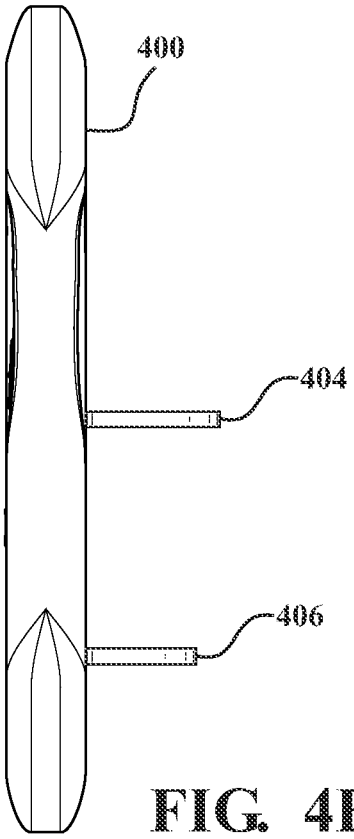
Figure 4F:
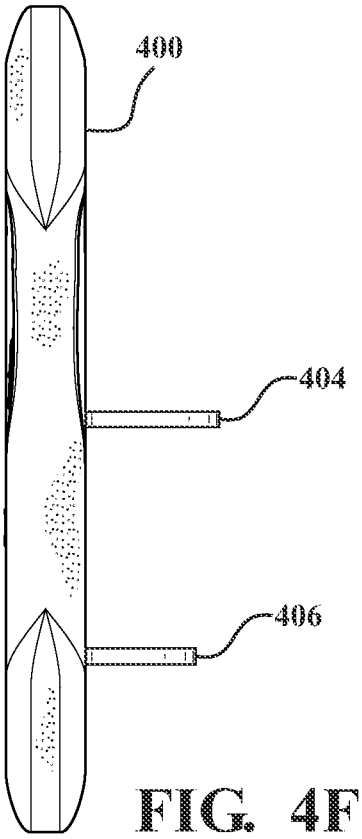

FIGS. 4E and 4F illustrate an elevation view of the bilateral kicking board 400. The board 400 has a height (i.e., a height if the board 400 were to be laid flat) of approximately 1". It is understood, however, that the board 400 may have a height of more or less than 1" and may be uniform or non-uniform as described above with respect to FIGS. 1E and 1F.

FIGS. 5A, 5B, 5C, 5D, 5E, and 5F illustrate a bilateral kicking board according to a fifth exemplary embodiment wherein like numerals, separated by a prefix of "5," identify similar components with the embodiments described above.

Figure 5B:
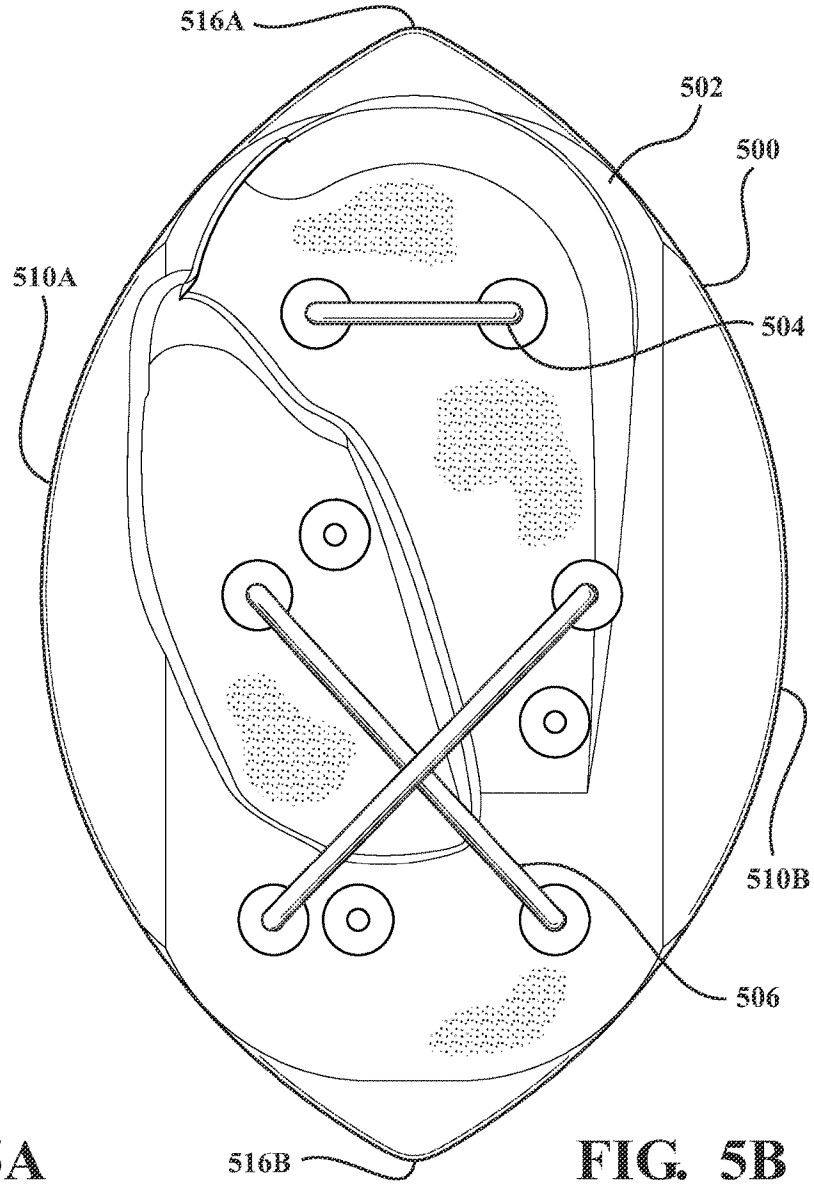
FIGS. 5A, 5B, 5C, 5D, 5E, and 5F illustrate a bilateral kicking board according to yet another exemplary embodiment.
Figure 5A:
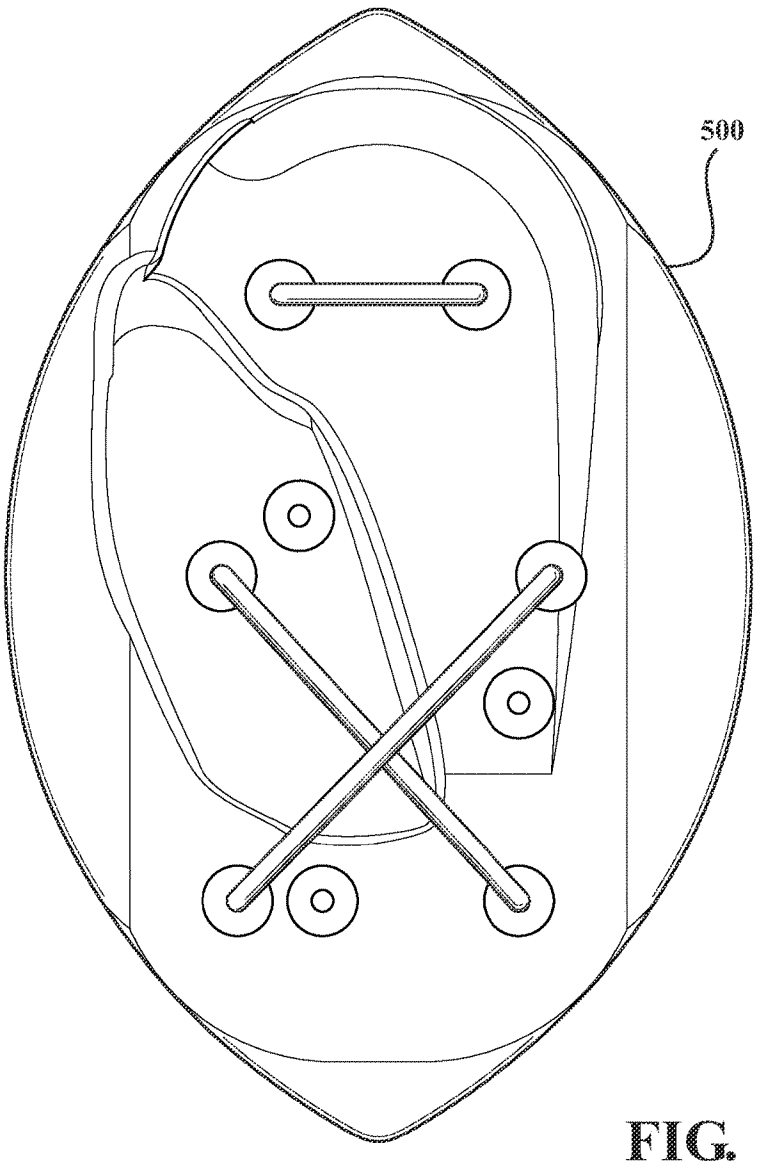

In FIG. 5A, the bilateral kicking board 500 according to an exemplary embodiment has a length of approximately 12" (vertical direction in FIG. 5A) and a width of approximately 7" (horizontal direction in FIG. 5A). The bilateral kicking board 500 also has a height of approximately 1" (see FIG. 5E). It is understood, however, that the dimensions of FIG. 5A are exemplary only and the bilateral kicking board 500 is not limited to these dimensions.

As shown in FIG. 5B, the board 500 includes a body 502 defined by two curved sides 510A and 510B that each have a semi-elliptical shape and intersect with each other at a first vertex 516A and a second vertex 516B, a finger strap 504, and a combined wrist and hand strap 506. One of the technical benefits of the shape of the board 500 is that the board 500 has excellent hydrodynamic sharpness. The body 502 may be made of the same materials as the body 302, e.g., foam, or any other type of material.

The finger strap 504 may be substantially the same dimensions as the finger strap 104 and may be made of the same materials as the finger strap 104. In the example shown in FIG. 5B, the finger strap 504 is made of silicon tubing.

The combined wrist and hand strap 506 may have substantially the same shape and be made of substantially the same materials as the combined wrist and hand strap 306.

Figure 5C:
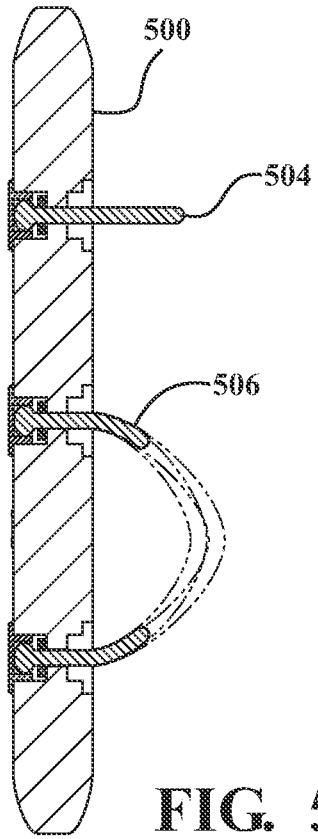
Figure 5D:
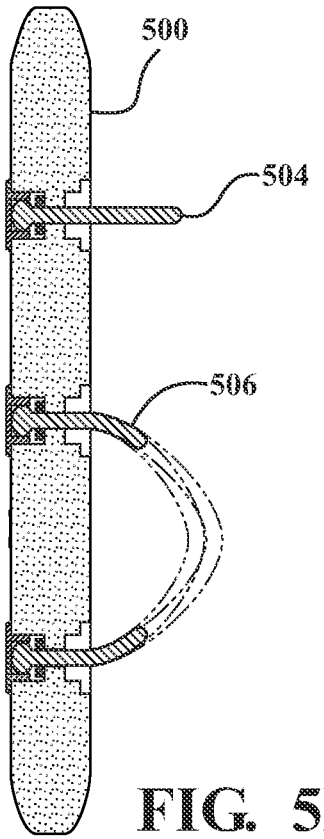

FIGS. 5C and 5D illustrate a sectional (cross-sectional) view of the bilateral kicking board 500. As shown therein, the finger strap 504 and combined wrist and hand strap 506 are sequentially arranged from the top to the bottom of the board 500 along the lengthwise direction of the body 502 (the direction in which the curved sides 510A and 510B extend), thereby achieving excellent gripping results for a student.

Figure 5E:
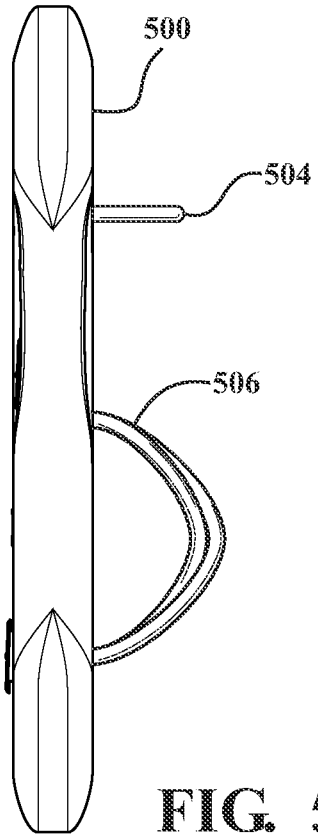
Figure 5F:
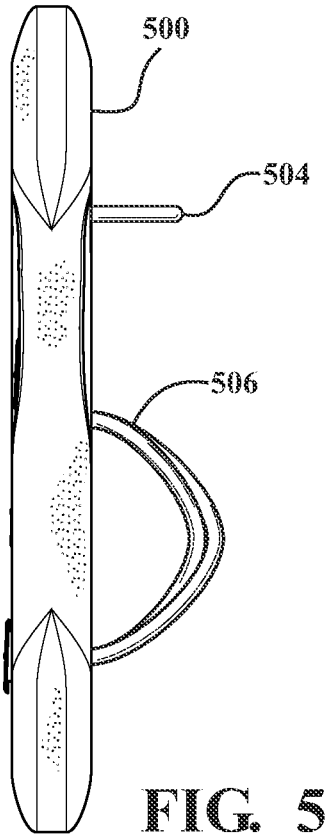

FIGS. 5E and 5F illustrate an elevation view of the bilateral kicking board 500. The board 500 has a height (i.e., a height if the board 500 were to be laid flat) of approximately 1". It is understood, however, that the board 500 may have a height of more or less than 1" and may be uniform or non-uniform as described above with respect to FIGS. 1E and 1F.

FIGS. 6A, 6B, 6C, 6D, 6E, and 6F illustrate a bilateral kicking board according to a sixth exemplary embodiment wherein like numerals, separated by a prefix of "6," identify like components with the embodiments described above.

Figure 6B:
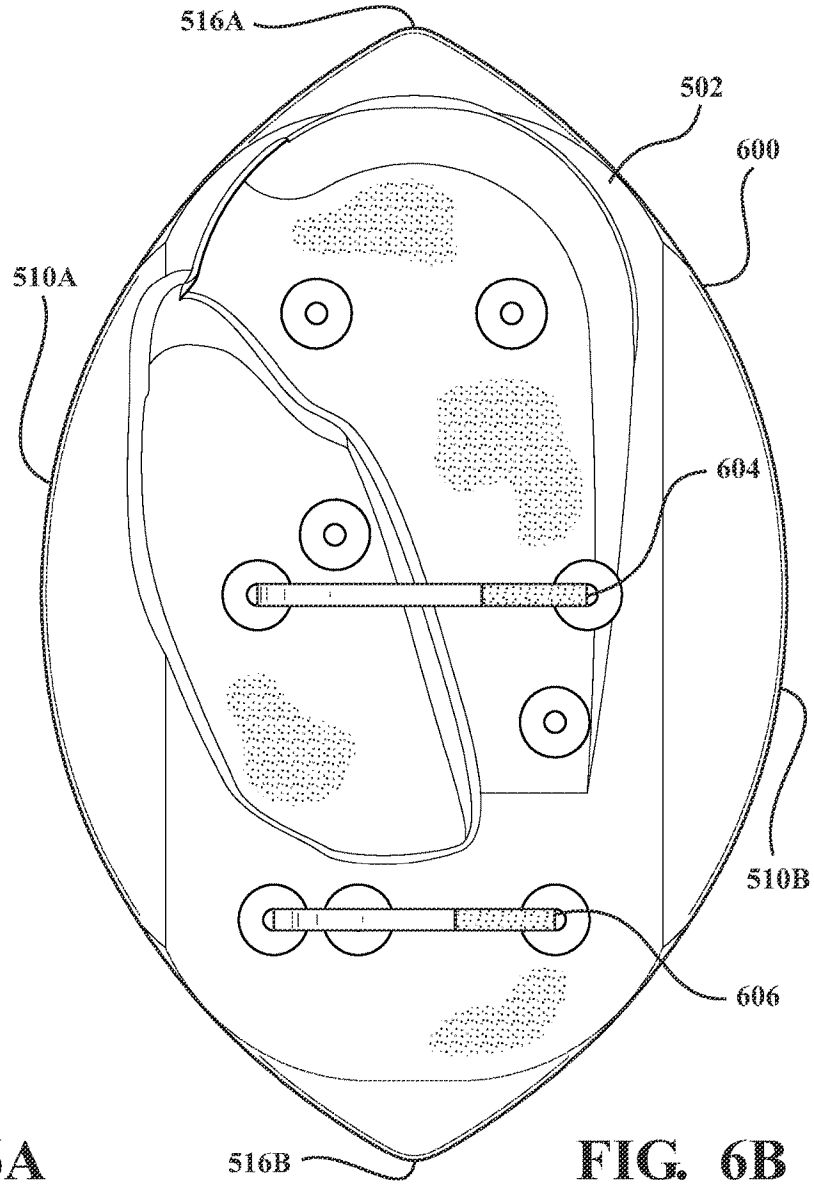
FIGS. 6A, 6B, 6C, 6D, 6E, and 6F illustrate a bilateral kicking board according to still another exemplary embodiment.
Figure 6A:
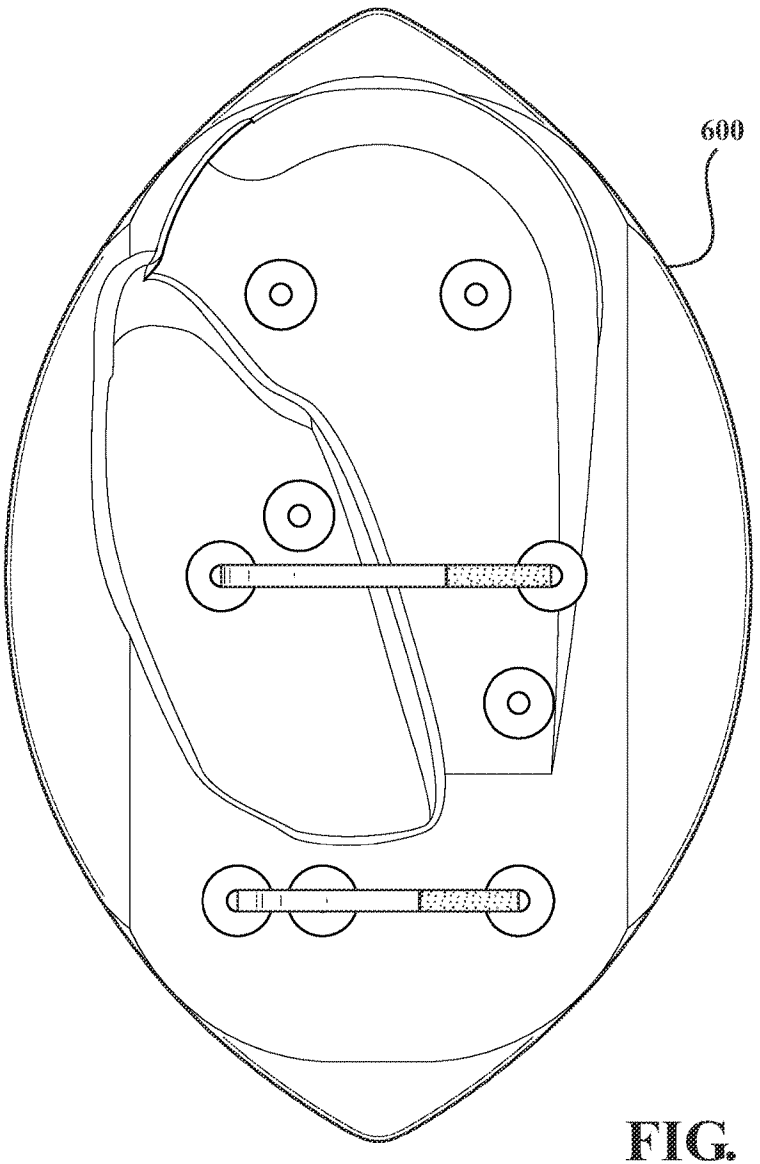

In FIG. 6A, the bilateral kicking board 600 according to an exemplary embodiment has a length of approximately 12" (vertical direction in FIG. 6A) and a width of approximately 7" (horizontal direction in FIG. 6A). The bilateral kicking board 600 also has a height of approximately 1" (see FIG. 6E). It is understood, however, that the dimensions of FIG. 6A are exemplary only and the bilateral kicking board 600 is not limited to these dimensions.

As shown in FIG. 6B, the body 502 of the board 600 is the same as the body 502 of the board 300 shown in FIG. 5B.

One of the differences between the board 600 and the board 500 is that the board 600 has a hand strap 604 and a wrist strap 606, but does not have a combined wrist and hand strap 506 like the board 500. Furthermore, the hand strap 604 and wrist strap 606 of the board 600 are each thicker than the hand strap 504 and combined wrist and hand strap 506 of the board 500.

According to an exemplary embodiment, the hand strap 604 and the wrist strap 606 may be made of the same material as the hand strap 206 and wrist strap 208 (see FIG. 2B).

Figure 6C:
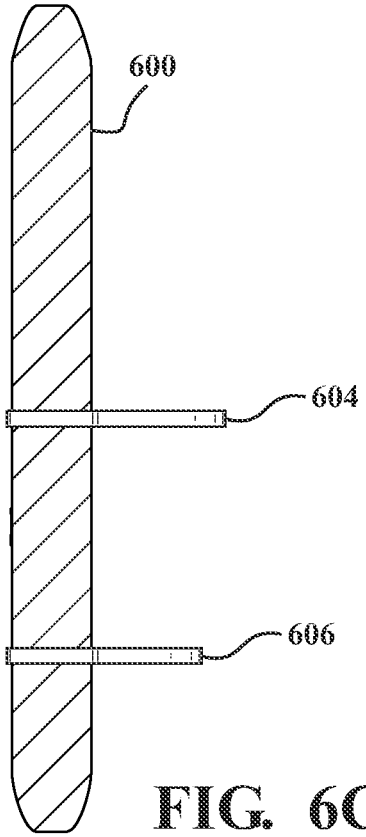
Figure 6D:
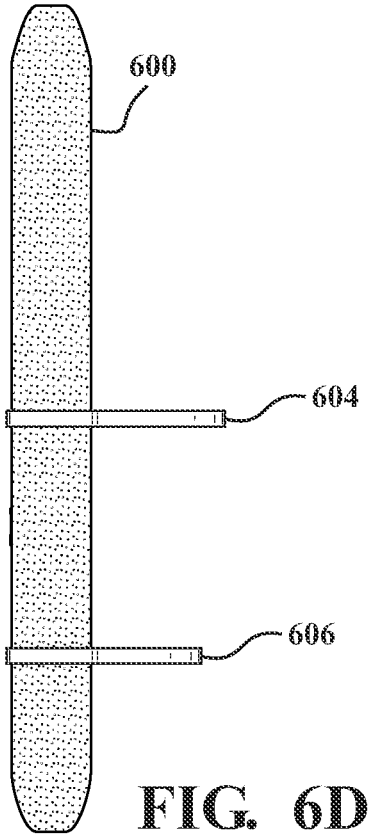

FIG. 6C and 6D illustrate a sectional (cross-sectional) view of the bilateral kicking board 600. As shown therein, the hand strap 604 and wrist strap 606 are sequentially arranged from a middle of the board 600 to the bottom of the board 600 along the lengthwise direction of the body 502 (the direction in which the long flat sides 510A and 510B extend), thereby achieving excellent gripping results for a student.

Figure 6E:
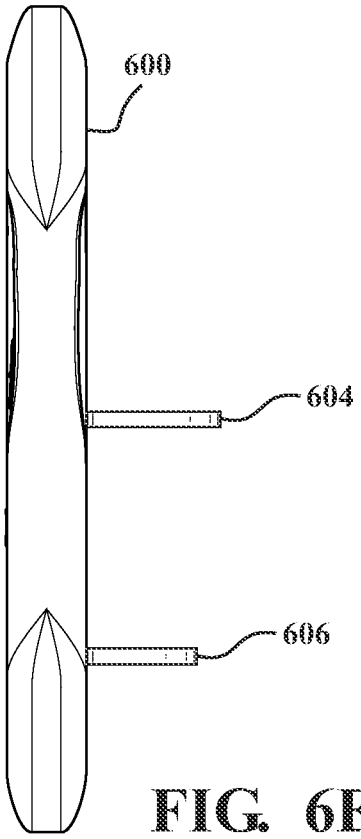
Figure 6F:
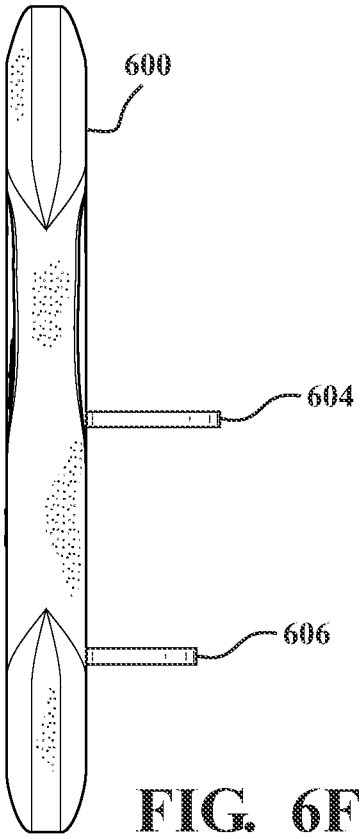

FIGS. 6E and 6F illustrate an elevation view of the bilateral kicking board 600. The board 600 has a height (i.e., a height if the board 600 were to be laid flat) of approximately 1". It is understood, however, that the board 600 may have a height of more or less than 1" and may be uniform or non-uniform as described above with respect to FIGS. 1E and 1F.

FIGS. 7-16, which are described in detail below, illustrate a series of Position and Transition Drawings in which a swimmer uses a set of bilateral kicking boards (specifically, the boards 100 of FIGS. 1A-F; however the boards of any of the aforementioned embodiments or other embodiments may be employed) according to an exemplary embodiment to move into, and transition between, various swimming positions. It is noted, however, that these Position and Transition Drawings are introductory in nature and are examples only; they are not, by any means, the only positions and transitions which can be achieved using the bilateral kickboards.

Figure 7:
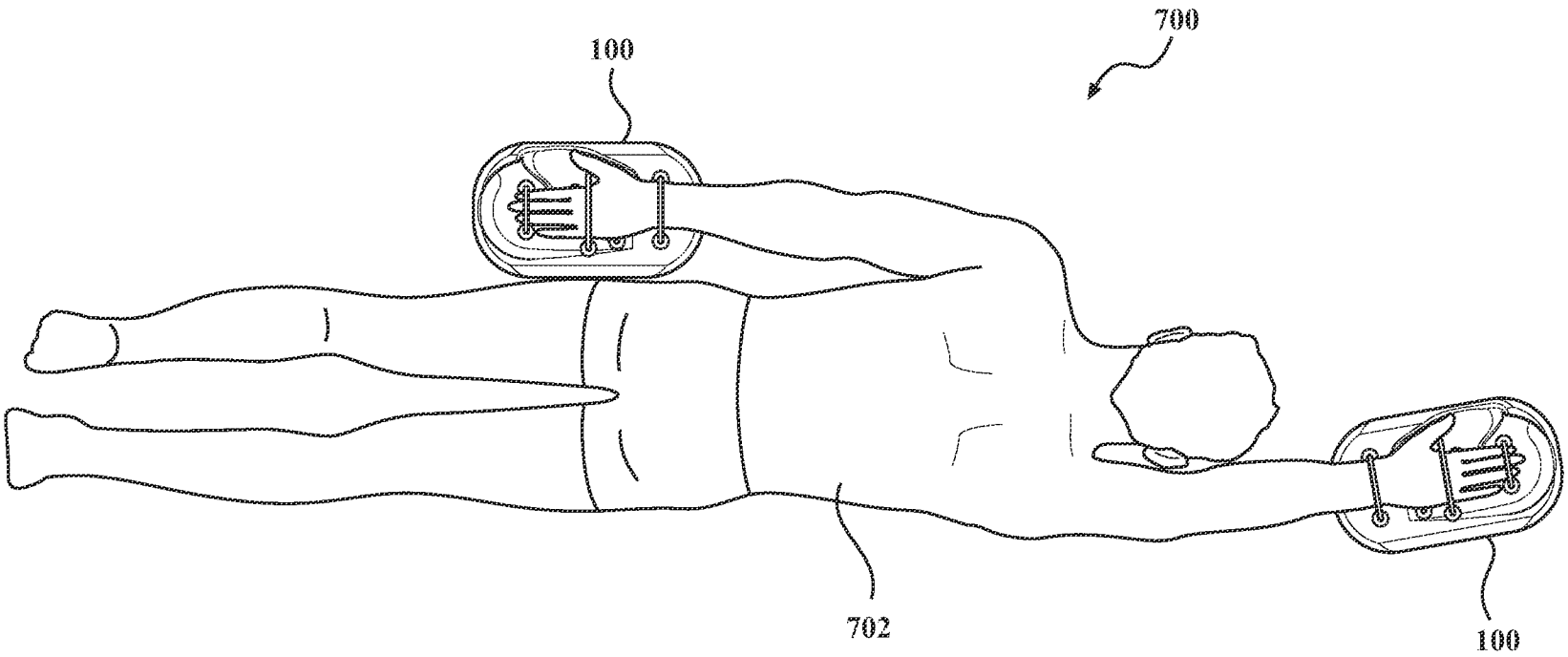
FIG. 7 illustrates a swimmer using a bilateral kicking board according to an exemplary embodiment to move into an "I" position while face down in the water.

FIG. 7 illustrates a swimmer using a bilateral kicking board according to an exemplary embodiment to move into an "I" position while face down in the water. The swimmer's left leg is up, demonstrating the board 100 is a kicking tool, used to help the aspiring swimmer kick themselves forward in the water so as to achieve their goals of either becoming a swimmer, or becoming a better swimmer by improving their kicking abilities.

As shown in FIG. 7, in the "I" position 700, the right arm (RA) of the swimmer 702 is extended out front and the left arm (LA) of the swimmer 702 is down at the side. The swimmer 702 is face down in the water. Both hands are strapped into the boards 100, and both hands are on top of the boards 100 which are on the surface of water (both thumbs point to the same direction).

Figure 8:
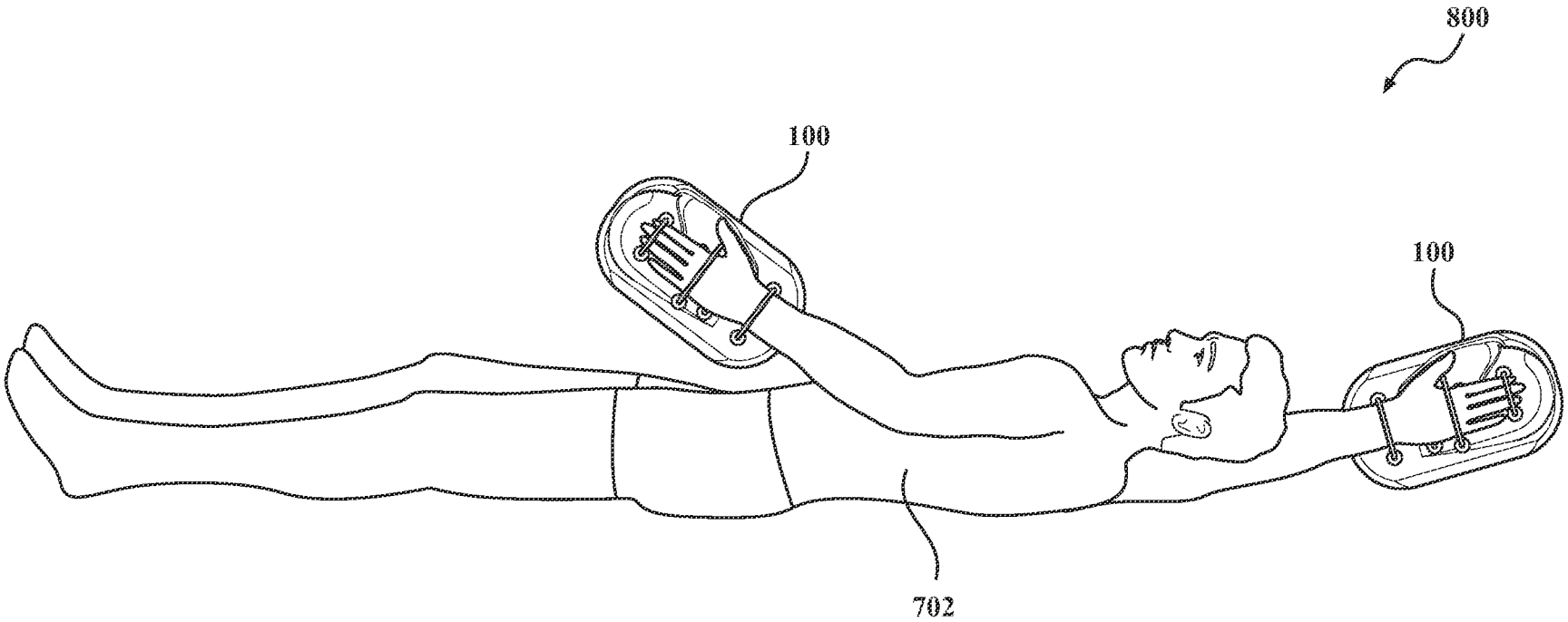
FIG. 8 illustrates the swimmer shown in FIG. 7 beginning to transition from the "I" position to an "H" position.

FIG. 8 illustrates the swimmer 702 shown in FIG. 7 beginning to transition from the "I" position to an "H" position. In this transitional position 800, the right arm (RA) is extended out front and the left arm (LA) is down at the side, however the left arm is on its way to the "H" such that the elbow is pointing on roughly a 160-degree angle and the tip of the left board 100 is on the surface of the water. The left arm resembles a volcano/triangle shape. The swimmer's face is facing left to breathe. The right eye is near the surface of the water, the left eye is higher, and the lips are curled to the ceiling.

Figure 9:
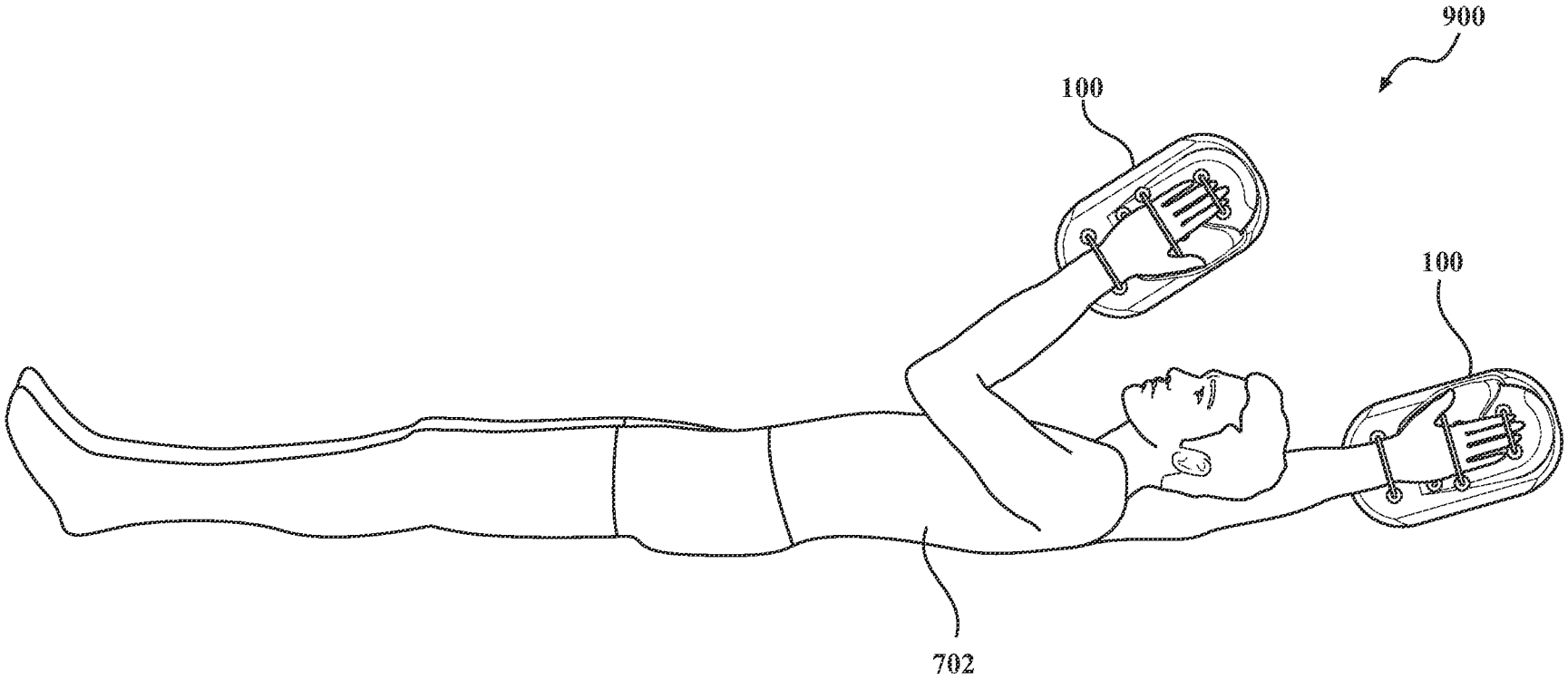
FIG. 9 illustrates the swimmer shown in FIG. 8 continuing the transition into the "H" position.

FIG. 9 illustrates the swimmer 702 shown in FIG. 8 continuing the transition into the "H" position. In this transitional position 900, the right arm (RA) is extended out front and the left arm (LA) is down at the side, however the left arm is on its way to the "H" position such that the elbow is pointing to roughly the 115 degree mark and the tip of the left board 100 is pointing at the water. The left board 100 is roughly 12 inches from the surface of the water. The left elbow is behind the left ear and the palm of the left hand is seen where the left thumb leads. The swimmer's face is almost totally in the water but slightly tilted so that the left ear is a little above the right ear. This position has been described as resembling an Archer pulling the bow to a maxed position before triggering the release of the arrow, except that the archer is on top of the water in a swimming position, as if looking at a Bullseye on the swimming floor (bottom of pool).

Figure 10:
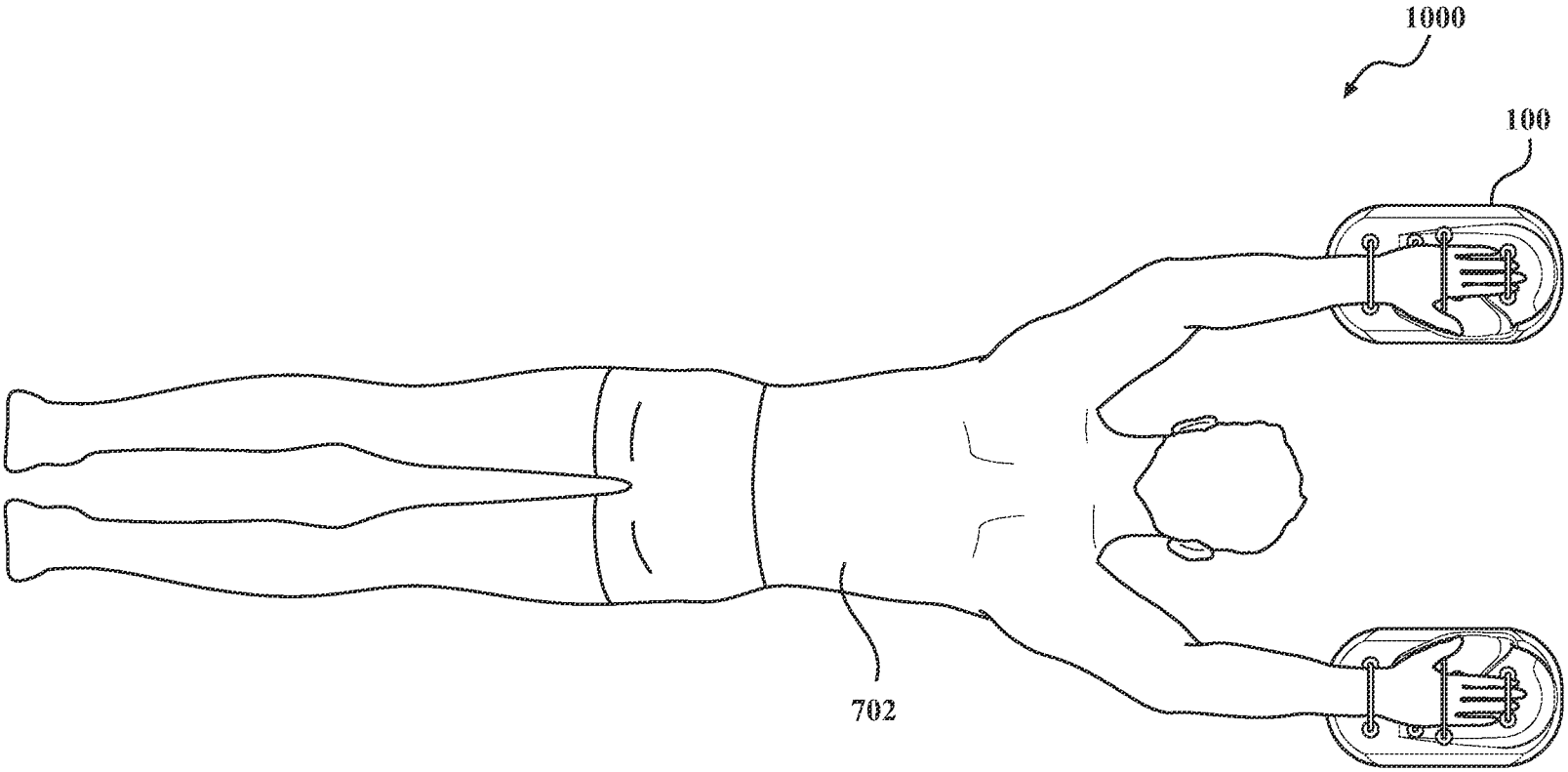
FIG. 10 illustrates the swimmer shown in FIG. 9 completing the transition to the "H" position.

FIG. 10 illustrates the swimmer 702 shown in FIG. 9 completing the transition to the "H" position. In the "H" position 1000, the RA and LA are fully extended out front and the swimmer's face is in the water. Both hands are on top of the boards 100 which are on the surface of the water. The knuckles are facing the ceiling/sky, and the elbows are somewhat facing the ceiling/sky such that the arms are slightly bent. The triceps are on top of the water showing that the swimmer is able to press down on the boards for an increased buoyancy feel. In this "H" position, the swimmer 702 is typically also kicking. This position is called the "H" position because the boards 100 should look like they are inside the gutters of a lane at a bowling alley, which is the separation required for this method.

Figure 11:
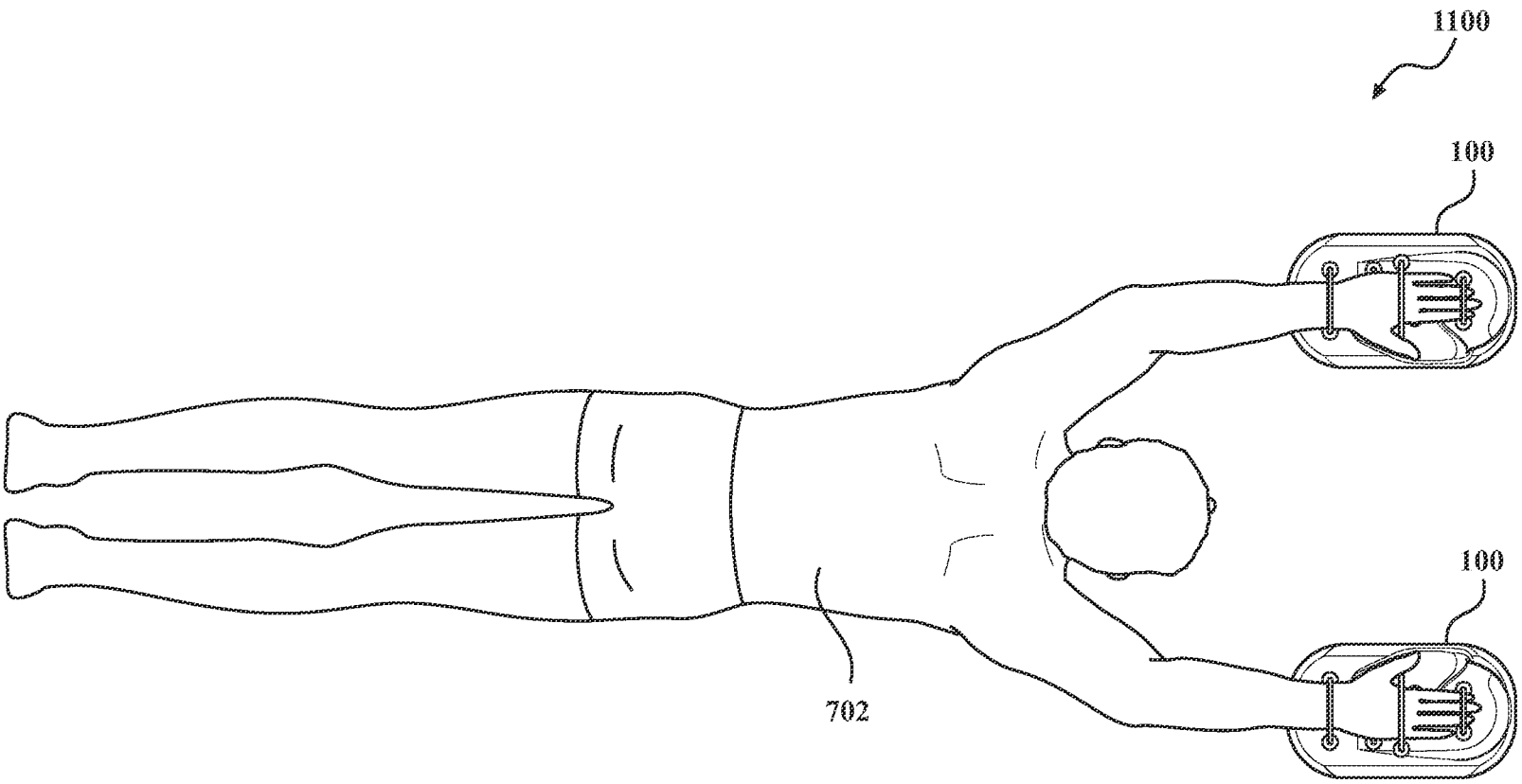
FIG. 11 illustrates the swimmer shown in FIG. 10 transitioning to a face up "H" position to breathe.

FIG. 11 illustrates the swimmer 702 shown in FIG. 10 transitioning from the "H" position to a face up position to breathe. In the face-up position 1100, the swimmer is in the "H" position and lifts his or her head out of the water to breathe.

Figure 12:
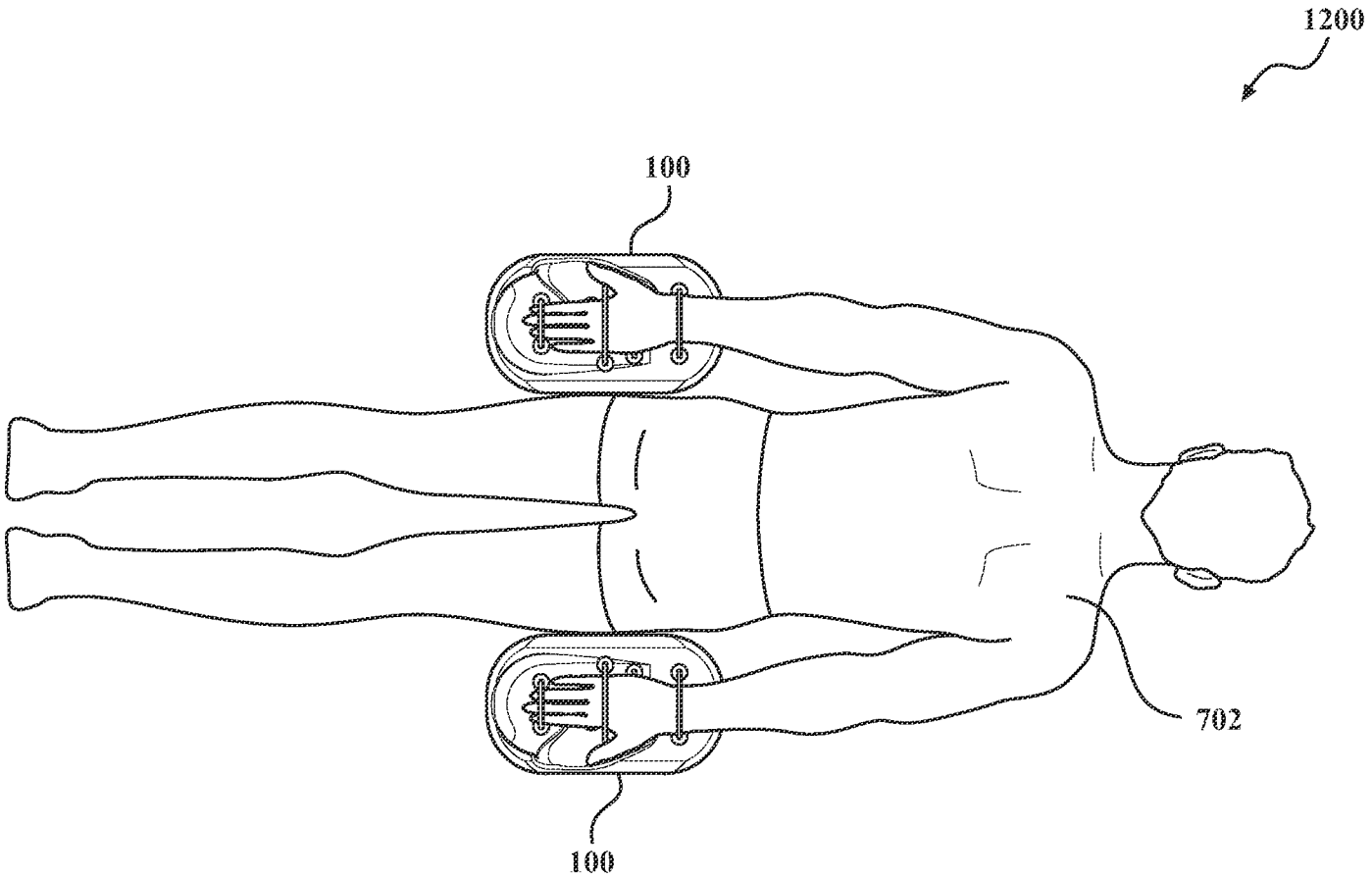
FIG. 12 illustrates the swimmer shown in FIG. 10 or 11 transitioned, from the "H" position, to the "M" position.

FIG. 12 illustrates the swimmer 702 shown in FIG. 10 or 11 transitioned to the "M" position. In the "M" position 1200, the RA and LA are down at the side as if the swimmer 700 were in a Super Woman pose, lying face down in the water holding a super woman cape on top of the water. The swimmer's knuckles are up, palms are down, and face is in the water. Both hands are on top of the boards 100 which are on the surface of water with the knuckles facing the ceiling/sky, and the elbows somewhat facing the ceiling/sky such that the arms are slightly bent. The triceps are on top of the water, showing that the swimmer is able to press down on the boards 100 for an increased buoyancy feel. The swimmer 702 in this "M" position 1200 could be kicking his/her legs in butterfly or freestyle, and the swimmer's face can be in the water, or if kicking butterfly face can be out of the water. If the swimmer 702 is a butterfly kicker, by pressing his or her hands down on the boards 100, the swimmer is able to get a breath while pressing down on the boards 100 because the swimmer's chest and head can get comfortably out of the water to get that breath due to the pressure they put on the boards 100.

Figure 13:
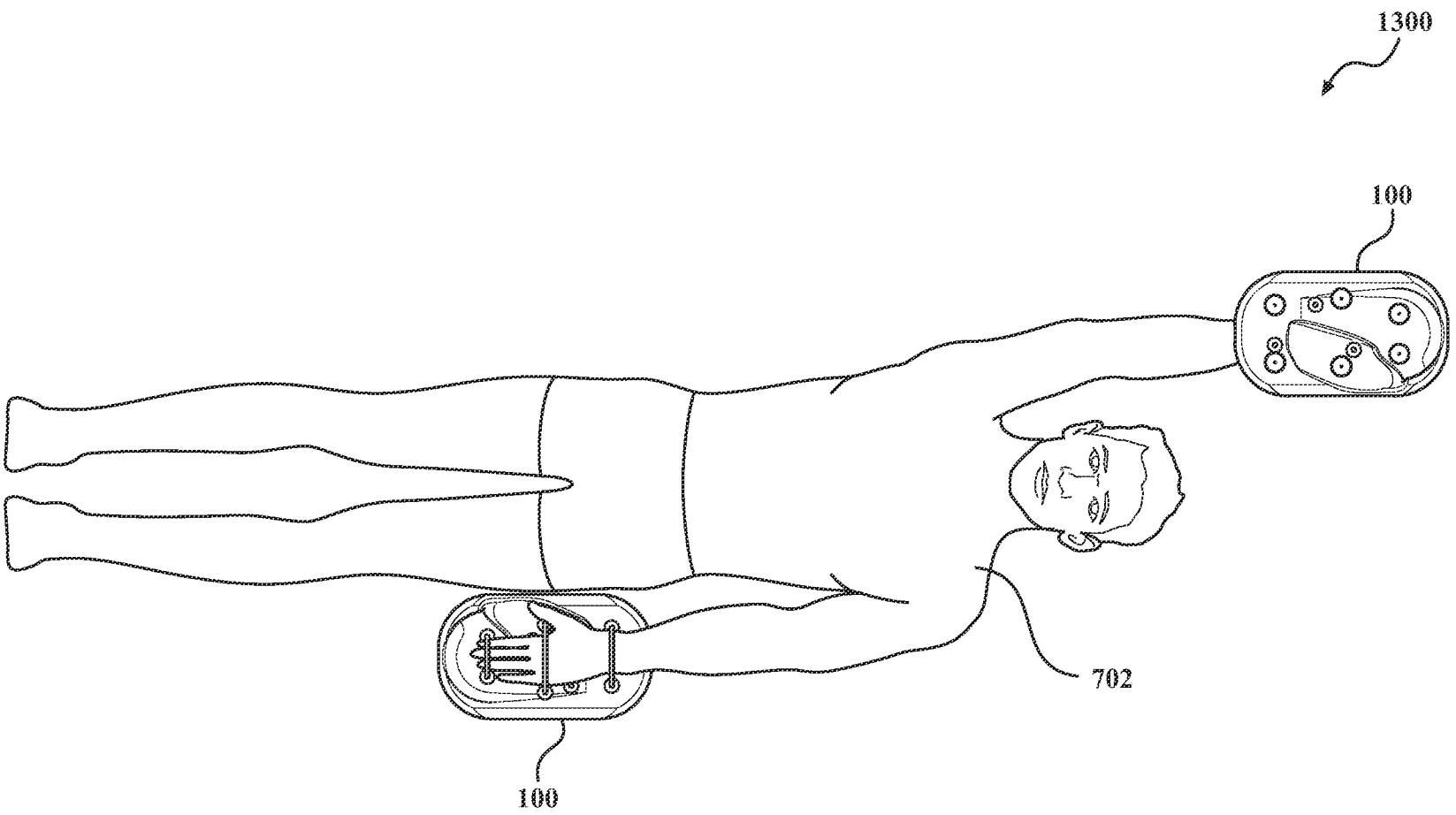
FIG. 13 illustrates the swimmer in an "I" position while face up in the water.

FIG. 13 illustrates the swimmer 702 in an "I" position while face up in the water. In the face-up "I" position 1300, the right arm (RA) is extended out front, and the palm of the RA is facing up. The left arm (LA) is down at the side so the left thumb is tight to the left thigh. The swimmer's face looks up 90 degrees towards the ceiling/sky. Both hands are on top of the boards 100 which are on the surface of the water (thumbs point in opposite directions).

Figure 14:
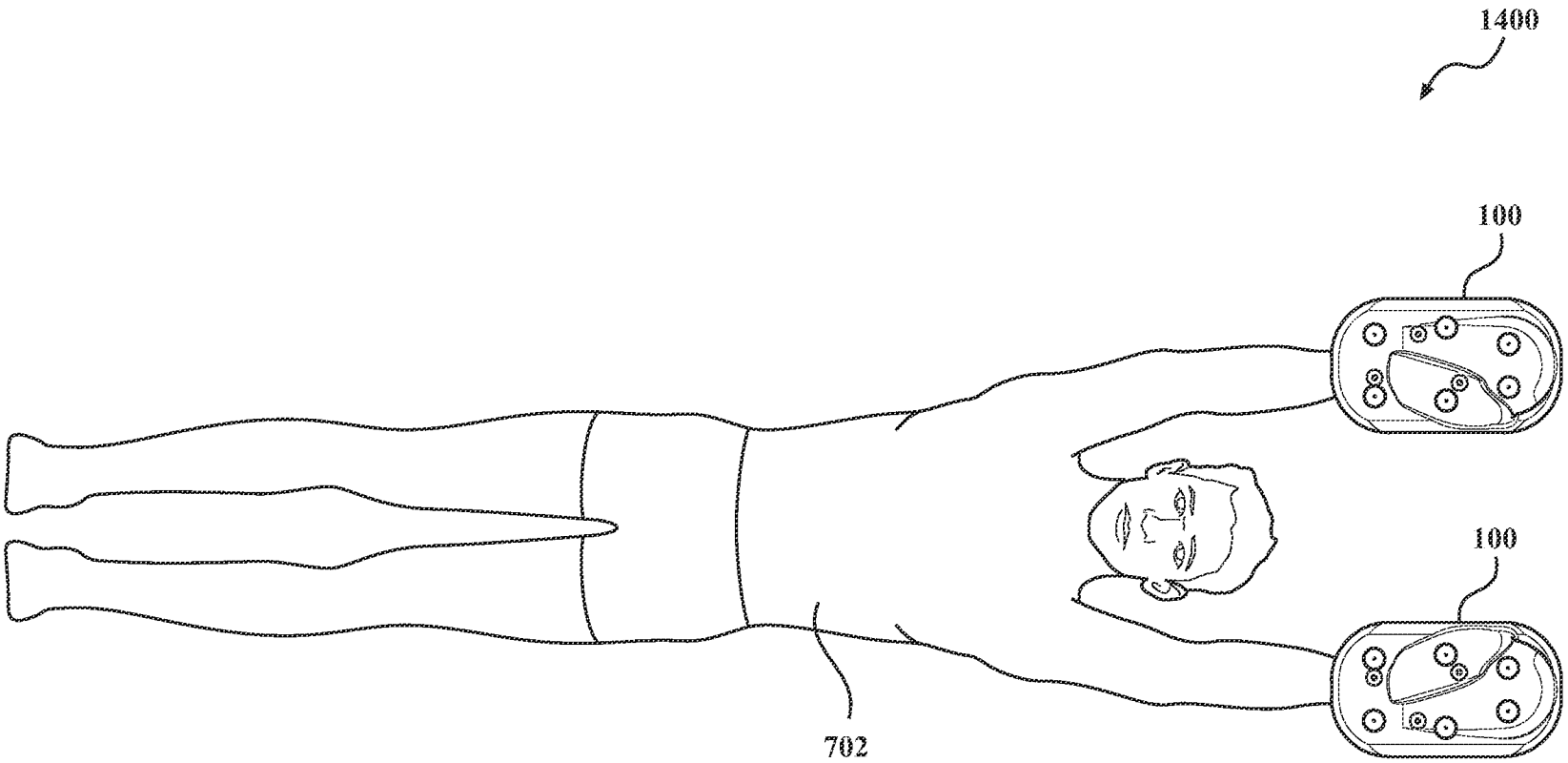
FIG. 14 illustrates the swimmer in an "H" position while face up in the water.

FIG. 14 illustrates the swimmer 702 in an "H" position while face up in the water. In the face-up "H" position, 1400, the swimmer 702 is basically in the opposite position as that of FIG. 10 (i.e., the face-down "H" position 1000). In the face-up "H" position, the swimmer 702 is relaxed while working the backstroke kick, the swimmer's eyes are looking up at the ceiling 90 degrees or thereabouts, and the fasteners of the boards 100 (e.g., straps, silicone tubing, etc.) are in the water such that the undersides of the boards 100, and not the tops of the board 100, are facing upwards.

Figure 15:
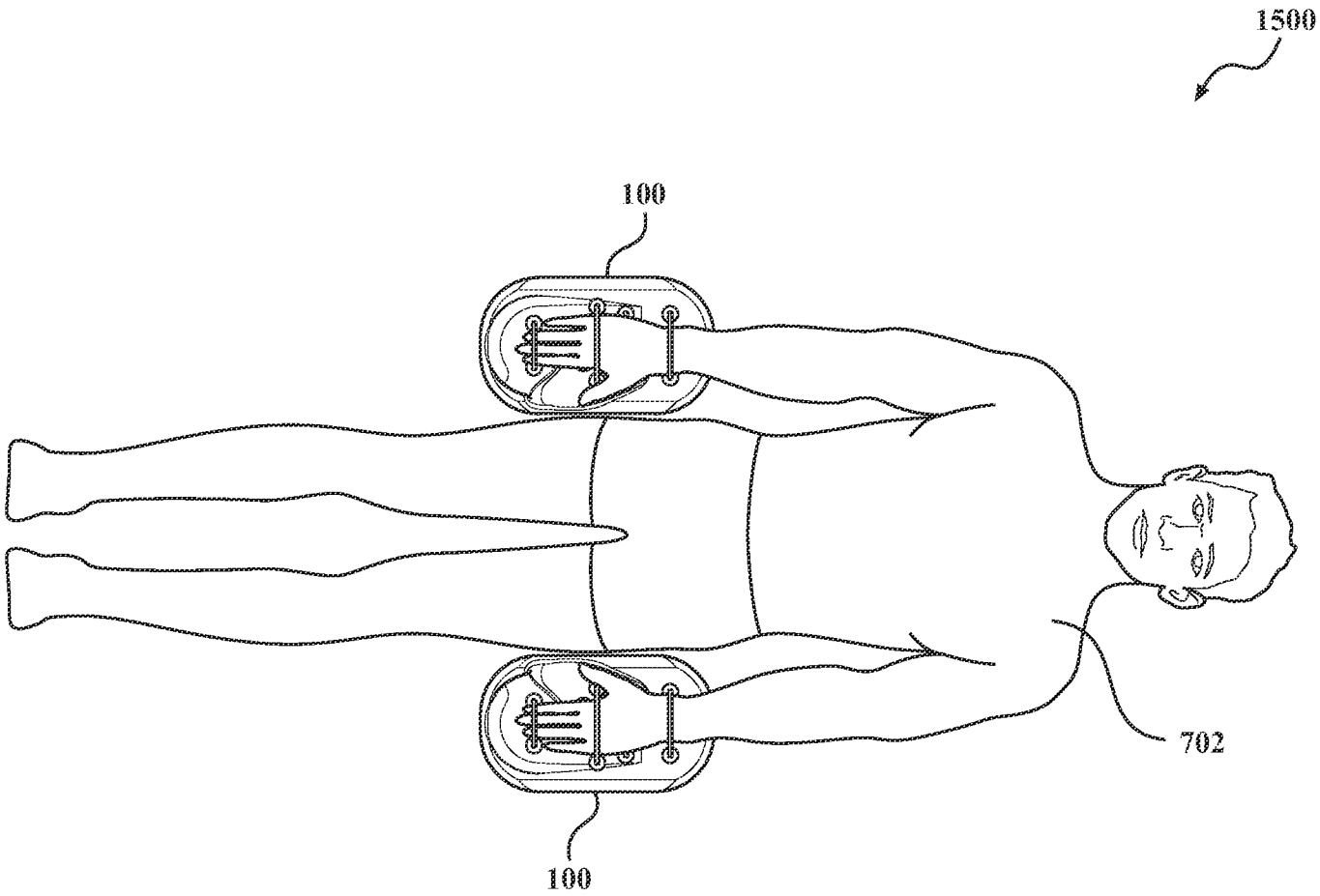
FIG. 15 illustrates the swimmer in an "M" position while face up in the water.

FIG. 15 illustrates the swimmer 702 in an "M" position while face up in the water. In the face-up "M" position 1500, the swimmer 702 is basically in the opposite position as that of FIG. 12 (i.e., the face-down "M" position). In the face-up "M" position 1500, using the Superwoman analogy, Superwoman (swimmer 702) is on her back as her cape rests on top of the water, with the swimmer's palms are on top of her cape. The swimmer 702 is relaxed while working the backstroke kick and the swimmer's eyes look up at the ceiling/sky at 90 degrees or thereabouts from the water's surface. The advanced swimmer, in this position, can work butterfly and breaststroke, or frog, kicks as well. The swimmer's thumbs are tight to the thighs, and both hands are strapped into the boards 100, which are on surface of the water, knuckles up.

Figure 16:
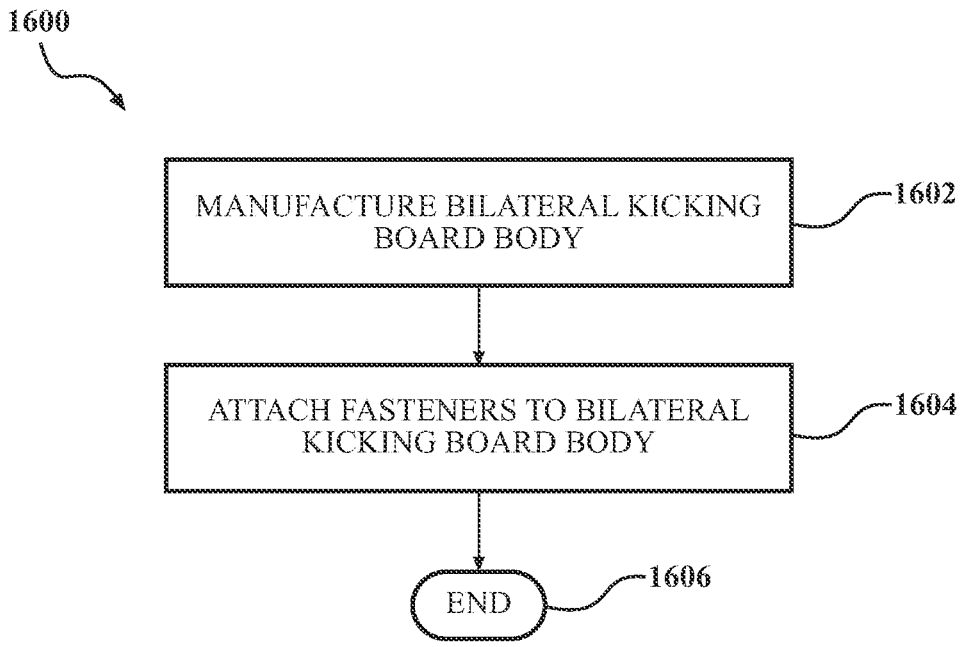
FIG. 16 illustrates a method of manufacturing a kickboard according to an exemplary embodiment.

FIG. 16 illustrates a flow chart of the method of manufacturing a kickboard according to an exemplary embodiment. The method 1600 shown in FIG. 16 can be used to manufacture any of the above-described kickboards 100, 200, 300, 400, 500, or 600.

At step 1602, the bilateral kicking board body is manufactured. For example, a manufacturer may fabricate the bilateral kicking board out of various types of foam or other inflatable materials.

At step 1604, fasteners are attached to the bilateral kicking body. In this example, the "fasteners" are the devices used to attach the kickboard body to the swimmer's hands, for example, silicon tubing, Velcro® straps, etc. The manufacturer may attach the fasteners to the body using many different types of techniques, such as by drilling holes into the body and then attaching the fastener using dowels, screws, etc. Alternatively, the end-user (e.g., the swimmer who purchases the board) may attach the fasteners.

At step 1706, the method ends.

Figure 18:
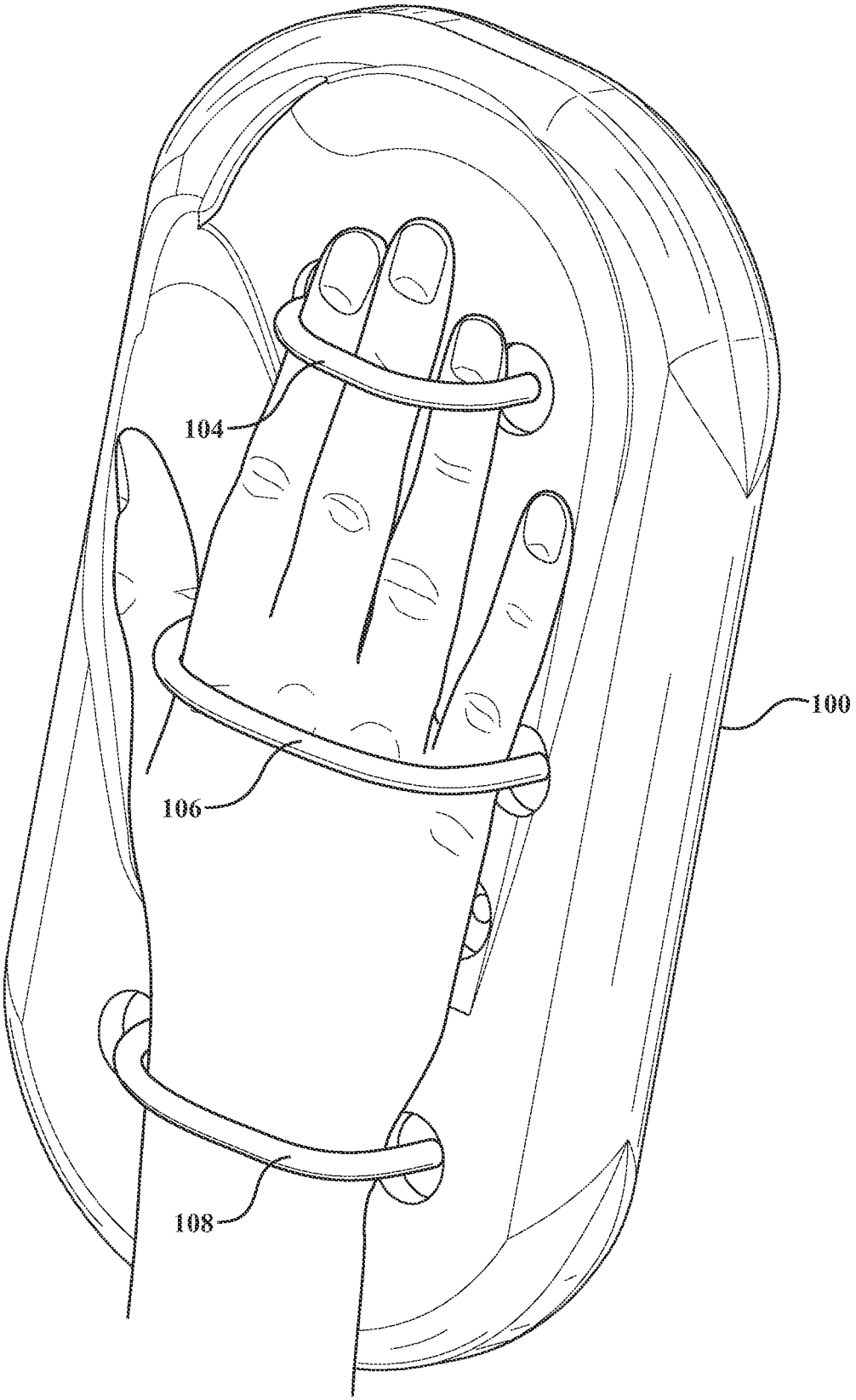
FIG. 18 illustrates a perspective view of the bilateral kicking board shown in FIGS. 1A-1F and with a hand in place.

FIGS. 17A-D illustrate a perspective view of the bilateral kicking board shown in FIGS. 1A-1F. As shown therein, the board 100 can include various combinations of straps, such as the silicon tube finger strap 104, silicon tube hand strap 106, and silicon tube wrist strap 108 (FIG. 17B), or the silicon tube finger strap 104 and the silicon tube wrist and hand strap 306 (FIG. 17C). FIG. 17B illustrates the straps 104, 106, 108 in an adult configuration, and FIG. 17D illustrates the straps 104, 106, 108 in a youth or junior configuration. FIG. 18 shows a swimmer's hand when using the board 100 shown in FIGS. 17B and 17C.

When it comes to the size of the boards, different approaches can be used. For example, the boards can be manufactured in the traditional small, medium and large sizes, where small is for kids, medium is for 10 to 13-year-olds and smaller adults, and large is for adults with bigger hands. Another approach to manufacture the boards is to have a one-size fits all approach where multiple holes are drilled so the user has the choice where to place the respective straps used to anchor the hand to the board. In the exemplary embodiment, nine holes are provided to accommodate different arrangements of straps for engagement with junior and adult hands. Regardless of the sizing used, the boards will likely be made of different materials, in other words, there would be a one size fits all made in a 4-pound density foam, 3-pound density, 2-pound density, etc. so that all swimmers could choose the foam that works best for their needs.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

Each of the different types and configurations of the fasteners described above may be combined with any of the different types of boards described above. For example, the combined wrist and hand strap 306 (FIG. 3) may be used with the foam body 102 (FIG. 1). Additionally, although the examples shown in FIGS. 1-6 show configurations using two or three fasteners, but the boards are not limited to this, and the boards may be manufactured using only one or more than three fasteners, and the fasteners may be arranged in many different types of configurations, spacings, etc. Moreover, although the examples shown in FIGS. 1-6 only show three particular shapes and sizes of the boards, the boards may be manufactured to have different sizes and shapes, for example, may be longer or shorter than those shown in FIGS. 1-6, may have different curvatures, etc.

While one or more exemplary embodiments have been described with reference to the figures, it will be understood by those of ordinary skill in the art that various changes in form and details may be made therein without departing from the spirit and scope as defined by the following claims.

What is claimed is:

1. A bilateral kicking board, comprising:

a body formed of a foam material, the body comprising:

first and second sides facing each other and extending in a lengthwise direction, the first and second sides having a same length in the lengthwise direction, third and fourth sides facing each other and extending in a widthwise direction perpendicular to the lengthwise direction, the third and fourth sides having a same width in the widthwise direction, the length of the first and second sides being longer than the width of the third and fourth sides, rounded corners interconnecting adjacent sides with one another, and at one surface of the body being contoured to better grip a hand of a swimmer;

a plurality of fasteners provided on a surface of the body and arranged along the lengthwise direction, the plurality of fasteners including a finger strap that is configured to fasten with at least one finger of the swimmer, a hand strap that is configured to fasten with the hand of the swimmer, and a wrist strap that is configured to fasten with the wrist or arm of the swimmer and is configured to lock a users's wrist against a surface of the body;

wherein the plurality of fasteners is sequentially arranged along the lengthwise direction and each of the fasteners is configured to fasten a different respective part of a swimmer's hand to the bilateral kicking board;

wherein the finger strap, the hand strap, and the wrist strap are flexible tubes that extend through respective ones of a plurality of openings in the body and wherein respective ends of the flexible tubes are connected with rivets that are dimensionally larger than the openings in the body to retain the flexible tubes with the body;

wherein at least a portion of the wrist strap is closer to one of the first and second sides than any portion of the wrist strap is to either of the third and fourth sides; and wherein the rivets are detachable from the flexible tubes so that the flexible tubes can be rearranged into different patterns using the openings to accommodate different hand sizes, and wherein the plurality of openings includes an adult set of hand strap openings configured to orient the hand strap in an adult configuration and a child set of hand strap openings configured to orient the hand strap in a child configuration, the child configuration being angled relative to the adult configuration.

2. The bilateral kicking board as set forth in claim 1 wherein the foam material includes at least one of an Expanded Polypropylene (EPP) foam, a Cross-linked Polyethylene (XLPE) with added Ethylene-Vinyl Acetate (EVA) foam, a Polystyrene (PS) foam, and an Expanded Polyethylene (EPE) foam.

3. A method of making a bilateral kicking board, comprising the steps of:

molding a foam material to make a body that has:

first and second sides facing each other and extending in a lengthwise direction, the first and second sides having a same length in the lengthwise direction, third and fourth sides facing each other and extending in a widthwise direction perpendicular to the lengthwise direction, the third and fourth sides having a same width in the widthwise direction, and wherein the length of the first and second sides is longer than the width of the third and fourth sides, rounded corners interconnecting adjacent sides with one another, and at least one surface of the body being contoured to better grip a hand of a swimmer;

joining a finger strap to the body adjacent the third side of the body;

joining a wrist strap to the body at a location such that at least a portion of the wrist strap is closer to one of the first and second sides than any portion of the wrist strap is to either the third side or the fourth side so that a swimmer's wrist can be locked against a surface of the body by the wrist strap;

joining a hand strap to the body at a location that is between the finger and wrist straps;

the finger strap, wrist strap, and hand strap being flexible tubes that extend through respective ones of a plurality of openings in the body and wherein respective ends of the flexible tubes are connected with rivets that are dimensionally larger than the openings in the body to retain the flexible tubes with the body; and the rivets being detachable from the flexible tubes so that the flexible tubes can be rearranged into different patterns using the plurality of openings to accommodate different hand sizes, and wherein the plurality of openings includes an adult set of hand strap openings configured to orient the hand strap in an adult configuration and a child set of hand strap openings configured to orient the hand strap in a child configuration, the child configuration being angled relative to the adult configuration.

* * * * *